US007026538B2

(12) United States Patent
Komano et al.

(10) Patent No.: US 7,026,538 B2
(45) Date of Patent: Apr. 11, 2006

(54) TONE GENERATION APPARATUS TO WHICH PLUG-IN BOARD IS REMOVABLY ATTACHABLE AND TONE GENERATION METHOD THEREFOR

(75) Inventors: Takeshi Komano, Hamamatsu (JP); Tetsuo Okamoto, Hamamatsu (JP); Motonori Sunako, Hamamatsu (JP)

(73) Assignee: Yamaha Corporation, Hamamatsu (JP)

( * ) Notice: Subject to any disclaimer, the term of this patent is extended or adjusted under 35 U.S.C. 154(b) by 391 days.

(21) Appl. No.: 09/935,542

(22) Filed: Aug. 22, 2001

(65) Prior Publication Data

US 2002/0023530 A1 Feb. 28, 2002

(30) Foreign Application Priority Data

Aug. 25, 2000 (JP) ..... 2000-255054
Aug. 25, 2000 (JP) ..... 2000-255055

(51) Int. Cl.
*G10H 1/06* (2006.01)
*G10H 7/00* (2006.01)

(52) U.S. Cl. ..... 84/622; 84/602; 84/610; 84/650; 84/659

(58) Field of Classification Search ..... 84/600–602, 84/610, 612, 622–626, 650, 652, 659, 660, 84/662

See application file for complete search history.

(56) References Cited

U.S. PATENT DOCUMENTS 5,569,869 A 10/1996 Sone
6,069,311 A 5/2000 Hiramatsu
6,103,965 A 8/2000 Kumagai
6,303,852 B1 * 10/2001 Kizaki et al. ..... 84/622

FOREIGN PATENT DOCUMENTS

JP 6-308990 A 11/1994
JP 2000-89760 3/2000

* cited by examiner

*Primary Examiner*—Marlon T. Fletcher
(74) *Attorney, Agent, or Firm*—Morrison & Foerster LLP

(57) ABSTRACT

To a tone generation apparatus is removably attachable a plug-in board for generating a tone on the basis of performance information and extending the tone generating function of the tone generation apparatus. Tone color name information and tone color parameter name information of tone color data possessed by the attached plug-in board is stored in a nonvolatile memory. Thus, any tone color possessed by the plug-in board can be known with reference only to the nonvolatile memory and without a need to refer to the plug-in board. The nonvolatile memory can also store tone color data of a custom voice obtained by editing original tone color data of the plug-in board. With this arrangement, the plug-in board is allowed to obtain the tone color data of the custom voice from the nonvolatile memory, as necessary.

23 Claims, 12 Drawing Sheets

SPECIFIC-PARAMETER EDITING SCREEN

BASIC SCREEN

VOICE SELECTING SCREEN

PLUG-IN-BOARD VOICE SELECTING SCREEN

STANDARD-PARAMETER EDITING SCREEN

DN=1, Bank Select MSB=50, Bank 0

| 1 | 0 | 1 | 0 | 0 | 1 | 0 | · · · · | 0 |
|---|---|---|---|---|---|---|---|---|

0 1 2 3 4 5 6 · · · · 127

PROGRAM CHANGE →

DN=1, Bank Select MSB=50, Bank 1

| 0 | 0 | 1 | 0 | 0 | 0 | 0 | · · · · | 0 |
|---|---|---|---|---|---|---|---|---|

0 1 2 3 4 5 6 · · · · 127

PROGRAM CHANGE →

DN=1, Bank Select MSB=50, Bank 2

| 1 | 0 | 0 | 0 | 0 | 0 | 0 | · · · · | 0 |
|---|---|---|---|---|---|---|---|---|

0 1 2 3 4 5 6 · · · · 127

PROGRAM CHANGE →

TONE GENERATION APPARATUS TO WHICH PLUG-IN BOARD IS REMOVABLY ATTACHABLE AND TONE GENERATION METHOD THEREFOR

BACKGROUND OF THE INVENTION

The present invention relates to tone generation apparatus to which a plug-in board is removably attachable and tone generation methods for use with the tone generation apparatus.

Hitherto, it has been known to attach, to a tone generator apparatus or electronic musical instrument, a tone-generating plug-in board (hereinafter also referred to as a tone generator plug-in board) for extending the tone generating functions or an effect imparting plug-in board (hereinafter also referred to as an effect plug-in board) for extending the effect functions. For example, by inserting or attaching such a tone generator plug-in board to a slot of an electronic musical instrument, tones different in type from those generatable by the electronic musical instrument alone can be generated depending on a particular nature of a tone generation scheme employed in the tone generator plug-in board, and also the number of simultaneously-generatable tones can be increased effectively. Examples of the tone generator mountable on the tone generator plug-in board include an analog modeling tone generator of an analog synthesizer based on a combination of "VCO+VCF+VCA", FM tone generator, waveform memory tone generator, and a physical model tone generator simulating the tone generating principles of an acoustic musical instrument. Further, by attaching an effect plug-in board to a slot of an electronic musical instrument, it is possible to impart a variety of effects such as a harmony effect.

One example of the tone generator apparatus where such a plug-in board can be used is disclosed in Japanese Patent Laid-open Publication No. HEI-10-319952 corresponding to U.S. Pat. No. 6,069,311. The disclosed tone generator apparatus is arranged to load, into the main body of the apparatus, names of tone colors selectively available from the plug-in board and names of parameters editable via the plug-in board and visually display the loaded tone color names and parameter names on a display of the main body of the apparatus. This tone generator apparatus, however, has the problem that each time a tone color is to be selected, there arises a need to transfer the tone color name, corresponding to a designated tone color number, from the plug-in board to the main body of the apparatus so as to display the tone color name, and thus the tone-color selection operation would take a relatively long time due to inquiries made to the plug-in board about the tone color selection. Also, each time a tone color parameter is to be edited, the disclosed tone generator apparatus operates to transfer the parameter name, corresponding to a designated parameter number, from the plug-in board to the main body of the apparatus so as to display the parameter name, and thus the parameter editing operation would take a relatively long time due to inquiries made to the plug-in board about the editing.

Further, although the main body of the apparatus sometimes requires editing of a custom voice possessed by (i.e., available from) the plug-in board, the custom voice is, in practice, edited outside the tone generator apparatus and then transferred to the plug-in board. Therefore, in the event that the main body of the apparatus edits the custom voice, the editing by the main body of the apparatus would conflict with the editing performed outside; for this reason, the editing by the main body of the apparatus is inhibited (or nor permitted) in the disclosed tone generator apparatus. Namely, there arises the problem that the main body of the apparatus can not edit a custom voice possessed by the plug-in board.

Further, examples of plug-in boards prepared for the conventional tone generator apparatus may include one which is equipped with a sequenced voice. The "sequenced voice" is such a voice whose tone color data include, in addition to ordinary data (such as those indicative of a waveform shape, pitch variations and tone volume envelope variations) pattern data, such as arpeggio pattern data, that indicate respective relative tone pitches, tone generation timing and duration of a plurality of notes. If such a sequenced voice is selected, a plurality of note-on/note-off events corresponding to the pattern data would be generated in response to a tone generation (note-on) instruction. However, because MIDI signals, which is performance information, are supplied directly to the plug-in board in the conventional tone generator apparatus, the supplied MIDI signals would not appropriately synchronize with a performance on the tone generator apparatus although they synchronize with externally supplied clock signals (i.e., MIDI tempo clock pulses).

Furthermore, with the plug-in board provided for the above-discussed conventional tone generator apparatus, custom voice data, obtained by editing preset voice data of the board, are stored in a volatile memory on the board. In this case, however, there would arise the problem that the custom voice stored in the volatile memory can not be used unless the custom voice data originally stored in an external device, such as a personal computer or sequencer, connected to the tone generator apparatus are transferred (bulk-transferred) to the volatile memory after turning on the power to (i.e., powering-up of) the tone generator apparatus.

Furthermore, in the conventional tone generator apparatus, each performance part using the tone generator of the plug-in board is selected in advance, and examples of the plug-in board include one designed as a mono-part tone generator which can be allocated or set to only one performance part and one designed as a multi-part tone generator which can be set to a plurality of performance parts. However, because the mono-part tone generator can be set to only one performance part, any other performance part can not use the tone generator of that plug-in board unless the settings of the parts using the plug-in board are changed. In this case, arrangements may be made for allowing any performance part to make use of the tone generator of the plug-in board in response to a tone color designating instruction (combination of bank select and program change), which would, however, lead to likelihood of the tone color of the mono-part tone generator being designated in a plurality of performance parts.

SUMMARY OF THE INVENTION

In view of the foregoing, it is a first object of the present invention to provide a tone generation apparatus which allows tone color name and parameter name information to be promptly obtained, without time-consuming inquiries made, whenever necessary.

It is a second object of the present invention to provide a tone generation apparatus which permits editing of tone color data of a custom voice without coming into conflict with editing performed outside the tone generation apparatus.

It is a third object of the present invention to provide a tone generation apparatus which, even when a sequenced voice is selected on a plug-in board, allows a performance on the plug-in board to synchronize with a performance on the main body of the tone generation apparatus.

It is a fourth object of the present invention to provide a tone generation apparatus which permits use of custom voice data without the voice data having to be transferred from outside the tone generation apparatus.

It is a fifth object of the present invention to provide a tone generation apparatus which allows a tone generator of a plug-in board to be used for any desired performance part without a need to change settings of performance parts using the plug-in board provided as a mono-part tone generator.

According to a first aspect of the present invention, there is provided an improved tone generation apparatus for generating a tone on the basis of performance information, a plug-in board being removably attachable to the tone generation apparatus, the plug-in board being capable of generating a tone on the basis of performance information and extending a tone generating function of the tone generation apparatus, the tone generation apparatus comprising: a nonvolatile memory that is capable of storing at least tone color name information and tone parameter name information of tone color data possessed by the plug-in board attached to the tone generation apparatus; a detector that detects whether a plug-in board replacement has taken place in the tone generation apparatus; and an updating processing section that, when it is detected by the detector that the plug-in board replacement has taken place, updates stored contents of the nonvolatile memory with tone color name information and tone parameter name information of tone color data possessed by another plug-in board newly attached to the tone generation apparatus.

As an example, the above-mentioned nonvolatile memory may be arranged to further store plug-in board identification information identifying the plug-in board attached to the tone generation apparatus, and the above-mentioned detector may detect whether or not the plug-in board replacement has taken place (i.e., the plug-in board has been replaced with another one) in the tone generation apparatus, by comparing plug-in board identification information obtained from the plug-in board attached to the tone generation apparatus and the plug-in board identification information stored in the nonvolatile memory.

With the arrangement that the tone color name information and tone color parameter name information is stored in the nonvolatile memory such as a flash ROM, the tone color name information and tone color parameter name information can be obtained without inquiring the plug-in board each time such information is required. In this way, a quick tone color selection can be made. Thus, whenever the plug-in board attached to the tone generation apparatus has been replaced with another plug-in board (i.e., whenever a plug-in board replacement has taken place), the present invention operates to collectively update the stored contents of the nonvolatile memory with a plurality of names of tone colors and parameters available from the other or newly attached plug-in board, so that even when the plug-in board replacement has taken place, it is possible to use any tone color possessed by the newly attached plug-in board.

According to a second aspect of the present invention, there is provided another improved tone generation apparatus to which a plug-in board is removably attachable, the plug-in board being capable of generating a tone on the basis of performance information and extending a tone generating function of the tone generation apparatus, the tone generation apparatus comprising: a tone generation section that generates a tone on the basis of performance information; a tone color selection section that selects tone colors of tones to be generated by the plug-in board attached to the tone generation apparatus and by the tone generation section; an offset editing section that edits a tone color possessed by the plug-in board attached to the tone generation apparatus, by adding desired modification data to tone color data of the tone color possessed by the plug-in board; and a transfer control section that, when the tone color selected by the tone color selection section has been edited by the offset editing section, transfers a tone color number and the modification data of the selected tone color to the plug-in board.

By the provision of the offset editing section for editing a tone color, possessed by the plug-in board, by adding desired modification data to tone color data of the tone color, the tone color possessed by the plug-in board can also be edited by the body of the tone generation apparatus. Because the offset editing section does not change values of the tone color parameter themselves, the editing by the offset editing section in the tone generation apparatus can be reliably prevented from conflicting with editing performed outside the tone generation apparatus. Furthermore, when the offset-edited tone color has been selected, the present invention causes the tone color number and modification data of the selected tone color to be transferred to the attached plug-in board, so that the attached plug-in board can generate a tone with the tone color having been offset-edited in accordance with the modification data.

According to a third aspect of the present invention, there is provided still another improved tone generation apparatus for generating a tone on the basis of performance information, a plug-in board being removably attachable to the tone generation apparatus, the plug-in board being capable of generating a tone on the basis of performance information and extending a tone generating function of the tone generation apparatus, the tone generation apparatus comprising: a performance information generation section that generates first performance information on the basis of a readout from a storage device; a performance information reception section that receives second performance information given from outside the tone generation apparatus; and a merging processing section that merges the first performance information generated by the performance information generation section and the second performance information received by the performance information reception section, to thereby provide merged performance information. Here, a tone is generated by at least one of the tone generation apparatus and the plug-in board on the basis of the merged performance information provided by the merging processing section.

For example, the present invention may be arranged to merge performance information, such as a MIDI signal, supplied from the outside and performance information, such as a MIDI signal, generated in the main body of the tone generation apparatus, and then supply the thus-merged performance information to the main body of the tone generation section and the attached plug-in board. This arrangement can synchronize tones generated by the plug-in board with a performance executed by the tone generation section in the tone generation apparatus.

According to a fourth aspect of the present invention, there is provided still another improved tone generation apparatus to which a plug-in board is removably attachable, the plug-in board being capable of generating a tone on the basis of performance information and extending a tone generating function of the tone generation apparatus, the tone generation apparatus comprising: a tone generation section that generates a tone through an automatic performance or automatic accompaniment based on tempo clock information; and a supply section that supplies the tempo clock information to the plug-in board attached to the tone generation apparatus. Thus, in the present invention, the plug-in board is allowed to generate a tone in synchronism with the tempo clock information supplied by the supply section. Namely, in this case, even when a sequenced voice has been selected as the tone color of said plug-in board for an automatic performance/accompaniment by the main body of the tone generation apparatus, the present invention allows a pattern performance of the sequenced voice to synchronize with the performance by the main body of the tone generation apparatus, as long as the main body of the tone generation apparatus is arranged to supply tempo clock pulses, to be used for the automatic performance/accompaniment, to the attached plug-in board as described above.

According to a fifth aspect of the present invention, there is provided still another improved a tone generation apparatus for generating a tone on the basis of performance information, a plug-in board being removably attachable to the tone generation apparatus, the plug-in board being capable of generating a tone on the basis of performance information and extending a tone generating function of the tone generation apparatus, the tone generation apparatus comprising: a nonvolatile memory that is capable of storing at least tone color information of a custom voice possessed by the plug-in board, the tone color information of the custom voice being information obtained by editing tone color information originally possessed by the plug-in board and capable of being used for tone generation by the plug-in board; and a control section that performs control to store, in the nonvolatile memory, the tone color information of the custom voice possessed by the plug-in board attached to the tone generation apparatus.

With the present invention thus arranged, the tone color information of the custom voice possessed by the plug-in board can be backed up to the nonvolatile memory in the main body of the tone generation apparatus. Therefore, even where the plug-in board is of the type that stores its tone color information of a custom voice in a volatile memory, the tone color information of the custom voice can be obtained from the nonvolatile memory in the main body of the tone generation apparatus whenever necessary.

As an example, the tone generation apparatus of the present invention may further comprise an input/output control section that transfers the tone color information of the custom voice, stored in the nonvolatile memory, to an external storage medium for saving, thereto, of the tone color information of the custom voice and that receives tone color information of a custom voice stored in an external storage medium and loads the received tone color information into the nonvolatile memory. With this arrangement, the custom voice tone color information can be stored reliably in the external storage medium.

According to a sixth aspect of the present invention, there is provided still another improved tone generation apparatus for generating a tone on the basis of performance information, a plug-in board being removably attachable to the tone generation apparatus, the plug-in board being capable of generating a tone on the basis of performance information and extending a tone generating function of the tone generation apparatus, the tone generation apparatus comprising: a nonvolatile memory that is capable of storing tone color information of a custom voice possessed by the plug-in board and plug-in board identification information identifying the plug-in board, the tone color information of the custom voice being information obtained by editing tone color information originally possessed by the plug-in board and capable of being used for tone generation by the plug-in board; a detector that, at powering-up of the tone generation apparatus, detects whether plug-in board identification information obtained from the plug-in board attached to the tone generation apparatus and the plug-in board identification information stored in the nonvolatile memory matches with each other; and a control section that, when it is detected by the detector that the plug-in board identification information obtained from the plug-in board attached to the tone generation apparatus and the plug-in board identification information stored in the nonvolatile memory matches with each other, transfers the tone color information of the custom voice, stored in the nonvolatile memory, to the plug-in board attached to the tone generation apparatus, to thereby write the tone color information of the custom voice into the plug-in board.

Thus, upon turning-on of the power to (i.e., powering-up of) the main body of the tone generation apparatus, the custom voice tone color information backed up to the nonvolatile memory in the main body of the tone generation apparatus can be written into the plug-in board, which allows the custom voice tone color information to be used immediately after the powering-up, without a need for transferring the custom voice tone color information from outside.

According to a seventh aspect of the present invention, there is provided still another improved tone generation apparatus to which a mono-part tone generator plug-in board is removably attachable, the mono-part tone generator plug-in board including a mono-part tone generator device that generates a tone in response to a performance of one particular performance part from among performances of a predetermined plurality of performance parts, the tone generation apparatus comprising: a tone generation section that generates tones of one or more performance parts in response to performances of one or more performance parts from among performances of a predetermined plurality of performance parts; a tone color selection section that selects tone colors of tones to be generated by the tone generation section and the mono-part tone generator device; and a control section that, when a tone color selected for a tone of one given performance part being generated by the mono-part tone generator device has been selected by the tone color selection section as a tone color for a tone of another performance part, inhibits generation of the tone of the one given performance part and performs control to cause the mono-part tone generator device to generate the tone of the other performance part with the selected tone color.

The present invention thus arranged permits efficient use of the mono-part tone generator plug-in board. In a situation where a tone color of the mono-part tone generator performance part plug-in board has been selected for one given performance part and when the same tone color of the mono-part tone generator plug-in board is subsequently designated for another performance part, the present invention operates to inhibit (mute) tone generation in the one given performance part and also set the designated tone color of the mono-part tone generator plug-in board to the other performance part. Thus, the mono-part tone generator plug-in board can be utilized in light of a latest tone color selection or allocation state. Consequently, even where the plug-in board is the mono-part tone generator plug-in board, the form of use of the plug-in board can be varied so as to allow allocation of the tone color to be shifted from one performance part to another, without a need for the user to bother to perform a troublesome operation for changing performance part settings. Note that the control section may, in stead of inhibiting the generation of the tone of the one given performance part, perform control to cause the tone generation section or the other plug-in board to generate the tone of the one given performance part with a substitute tone color for the selected tone color.

According to an eighth aspect of the present invention, there is provided still another improved tone generation apparatus to which a mono-part tone generator plug-in board is removably attachable, the mono-part tone generator plug-in board including a mono-part tone generator device that generates a tone in response to a performance of one particular performance part from among performances of a predetermined plurality of performance parts, the tone generation apparatus comprising: a tone generation section that generates tones of one or more performance parts in response to performances of one or more performance parts from among performances of a predetermined plurality of performance parts; a tone color selection section that selects tone colors of tones to be generated by the tone generation section and the mono-part tone generator device; and a control section that, when a tone of one given performance part being generated by the mono-part tone generator device corresponds to a manual performance and when a tone color selected for the tone of the one given performance part has been selected by the tone color selection section as a tone color for a tone of another performance part, inhibits generation of the tone of the other performance part and thereby allows the mono-part tone generator device to continue generating the tone of the one given performance part with the selected tone color.

In a situation where the tone color of the mono-part tone generator has been selected for a manual performance part, the present invention inhibits the tone color of the mono-part tone generator from being set to another performance part even when the tone color of the mono-part tone generator is designated for the other performance part, so that the present invention can effectively prevent unnaturalness or unsuitability in performance tones of the manual performance.

The present invention may be constructed and implemented not only as the apparatus invention as discussed above but also as a method invention. Also, the present invention may be arranged and implemented as a software program for execution by a processor such as a computer or DSP, as well as a storage medium storing such a program. Further, the processor used in the present invention may comprise a dedicated processor with dedicated logic built in hardware, not to mention a computer or other general-purpose type processor capable of running a desired software program.

While the embodiments to be described herein represent the preferred form of the present invention, it is to be understood that various modifications will occur to those skilled in the art without departing from the spirit of the invention. The scope of the present invention is therefore to be determined solely by the appended claims.

BRIEF DESCRIPTION OF THE DRAWINGS

For better understanding of the object and other features of the present invention, its embodiments will be described in greater detail hereinbelow with reference to the accompanying drawings, in which.

DETAILED DESCRIPTION OF EMBODIMENTS

Figure 1:
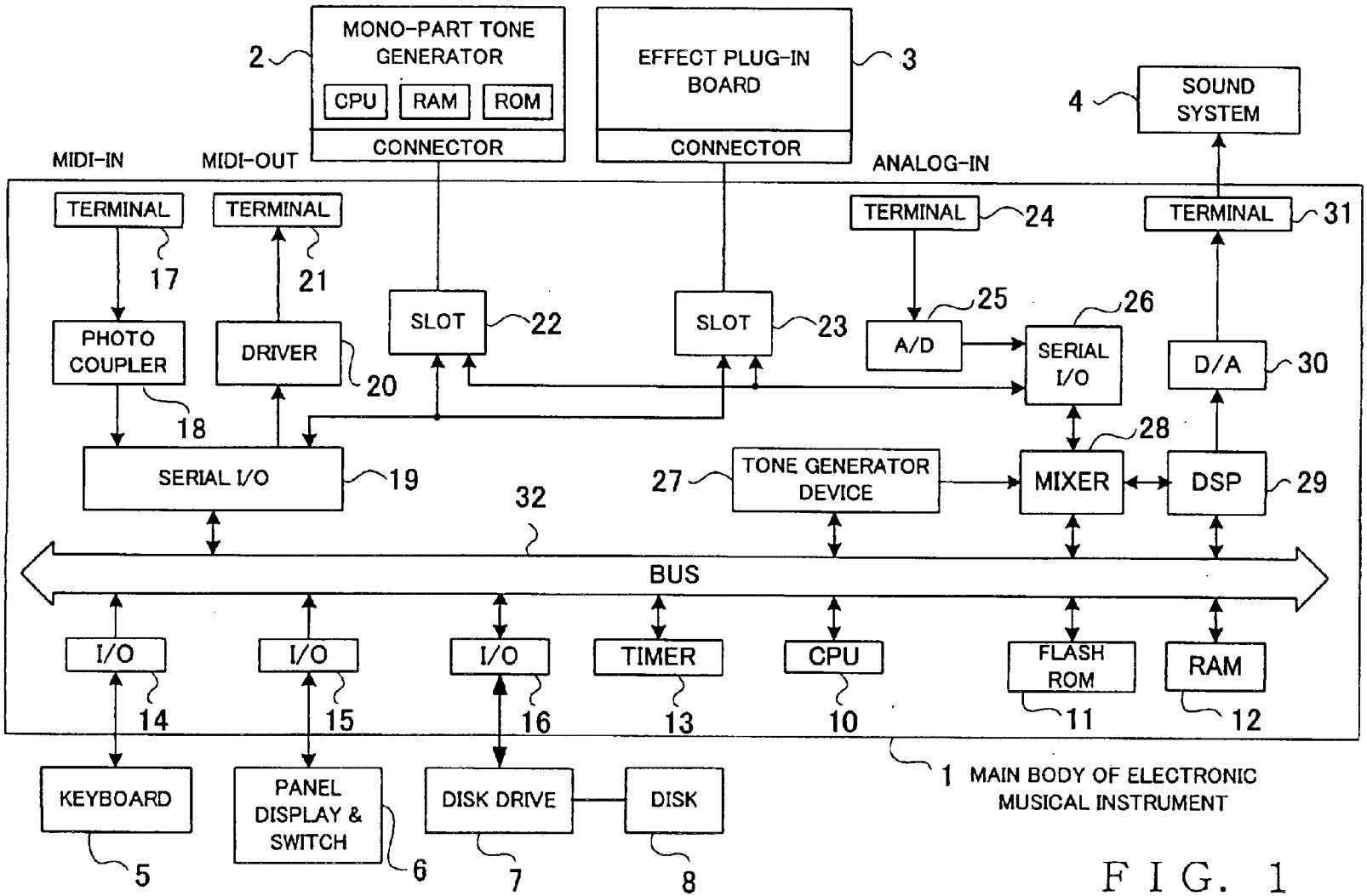
FIG. 1 is a block diagram showing a general setup of an electronic musical instrument to which is applied a tone generation apparatus in accordance with an embodiment of the present invention.

FIG. 1 is a block diagram showing a general setup of an electronic musical instrument to which is applied a tone generation apparatus in accordance with an embodiment of the present invention.

In FIG. 1, the main body of the electronic musical instrument 1 generates tone signals on the basis of MIDI (Musical Instrument Digital Interface) data that are events input from a keyboard 5, or MIDI data received from equipment, such as a personal computer, capable of supplying such MIDI data, and sends each of the thus-generated tone signals to a sound system 4. Also, the main body of the electronic musical instrument 1 is capable of executing an automatic performance/automatic accompaniment on the basis of automatic performance/automatic accompaniment data stored in an internal storage section. Plug-in board 2, designed as a mono-part tone generator plug-in board, has a connector inserted in or attached to a first slot ("Slot 1") 22 of the main body of the electronic musical instrument 1. This plug-in board 2 is equipped with a controlling CPU and a tone generator circuit so that the board 2 can singly operate as an independent tone generator; that is, the tone generating functions or capabilities of the main body of the electronic musical instrument 1 can be extended by the attachment thereto of the plug-in board 2. Further, another plug-in board 3, designed as an effect plug-in board, has a connector inserted in or attached to a second slot ("Slot 2") 23 of the main body of the electronic musical instrument 1, so that the effect imparting functions or capabilities of the main body of the electronic musical instrument 1 can be extended by the attachment thereto of the plug-in board 3.

The sound system 4 includes amplifiers and speakers for audibly reproducing or sounding each of the tone signals output from the main body of the electronic musical instrument 1. The keyboard 5 contains a CPU and generates and outputs MIDI data corresponding to user's operation of any one of the keys. Panel display and switch section 6 includes a display device in the form of an LCD (Liquid Crystal Display) or the like provided on a control panel of the main body of the electronic musical instrument 1, and user-operable panel switches including LCD buttons for selecting any desired one of items on a screen shown on the display device and tone-color selecting buttons for selecting any desired tone colors to be generated on the plug-in board and the main body of the electronic musical instrument 1. The user is allowed to perform various operations by manipulating the panel switches. Disk drive 7 is provided for storing performance-related data, contained in a flash ROM 11 of the main body of the electronic musical instrument 1, onto a disk 8 installed therein or for loading performance-related data, stored on the disk 8, into the flash ROM 11 of the main body of the electronic musical instrument 1. The disk drive 7 may comprise one or more of an HDD (Hard Disk Drive), FDD (Floppy Disk Drive), CD (Compact Disk)-ROM drive, MO (Magneto-Optical Disk) drive, DVD (Digital Versatile Disk) drive, etc.

Figure 2:
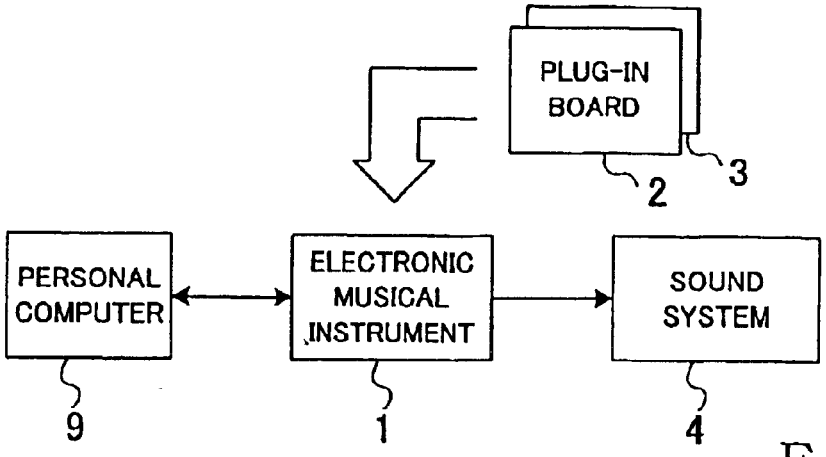
FIG. 2 is a block diagram of an exemplary overall system including the tone generation apparatus in accordance with the embodiment of the present invention.

FIG. 2 is a block diagram of an exemplary overall system including the tone generation apparatus in accordance with the embodiment of the present invention. Electronic musical instrument 1 shown in FIG. 2 is the main body of the electronic musical instrument 1 of FIG. 1 including the keyboard 5, panel display and switch section 6 and the disk drive 7. This electronic musical instrument 1 is connected with a personal computer (PC) 9, and outputs from the electronic musical instrument 1 are supplied to the sound system 4. The plug-in boards 2 and 3 are removably attachable to the first and second slots. In this instance, by attaching such a tone generator plug-in board to the first or second slot of the electronic musical instrument 1, tones different in type from those generatable by the electronic musical instrument 1 alone can be generated depending on a particular nature of the tone generation scheme employed in the tone generator plug-in board, and also the number of simultaneously-generatable tones can be increased. Possible examples of the tone generator plug-in board include an analog modeling tone generator of an analog synthesizer based on a combination of "VCO+VCF+VCA", FM tone generator, waveform memory tone generator, and a physical model tone generator simulating the tone generating principles of an acoustic musical instrument. Further, examples of the tone generator plug-in board include a mono-part tone generator to which can be allocated or set a tone color of only one performance part or a multi-part tone generator to which can be allocated or set tone colors of a plurality of performance parts. Further, if an effect plug-in board is attached to the first or second slot 22 or 23 of the electronic musical instrument 1, it is possible to impart a variety of effects such as a harmony effect.

Referring back to FIG. 1, a CPU (Central Processing Unit: system CPU) 10 in the main body of the electronic musical instrument 1 carries out various control on the basis of control programs stored in the flash ROM 11. The flash ROM 11 is a non-volatile ROM (Read-Only Memory) in which are stored various programs, such as a tone generating program, tone-color selecting program, tone color editing program and control programs, for execution by the system CPU 10 and various data such as tone color data of board custom voices of the plug-in board and modification data for editing tone color parameters, as will be later described. The main body of the electronic musical instrument 1 also includes a system RAM 12 which is a RAM (Random Access Memory) where are set storage areas storing for performance data and various other data, working areas for use by the system CPU 10, etc. Timer 13 is provided for counting an elapsed time during an operation and generates timer interrupt signals at predetermined time intervals. I/O 14 is an input/output means (interface) through which MIDI data output from the CPU-containing keyboard 5 are introduced into the main body of the electronic musical instrument 1. Another I/O 15 is an input/output means through which data are bidirectionally transferred between the panel display and switch section 6 and the main body of the electronic musical instrument 1. Still another I/O 16 is an input/output means through which data are bidirectionally transferred between the disk drive 7 and the main body of the electronic musical instrument 1.

MIDI-IN terminal 17 is a terminal via which external MIDI equipment, such as a personal computer or sequencer, is connected to the main body of the electronic musical instrument 1 by means of a MIDI cable. MIDI data output from the personal computer or the like are introduced onto a bus 32 of the main body of the electronic musical instrument 1 via the MIDI-IN terminal 17, photocoupler 18 and serial I/O 19. Further, a MIDI-OUT terminal 21 is a terminal via which the main body of the electronic musical instrument 1 is connected via a MIDI cable to the personal computer or the like. MIDI data are output from the main body of the electronic musical instrument 1, via the serial I/O 19, driver 20 and MIDI-OUT terminal 21, to the personal computer or the like. Note that the photocoupler 18 has a function of isolating the MIDI-IN terminal 17 and serial I/O 19 from each other in terms of a D.C. current flow therebetween, and the driver 20 has a function of amplifying the MIDI data. Further, the serial I/O 19 is an input/output means which converts serial data, supplied from the photocoupler 18 or first or second slot 22 or 23, into parallel data to transfer the converted parallel data to the bus 32 and which also converts parallel data, sent from the bus 32, into serial data to transfer the converted serial data to the bus driver 20 or first or second slot 22 or 23. The first slot 22 is a slot to which can be removably attached a plug-in board that may be either a desired tone generator plug-in board or a desired effect plug-in board. The second slot 23 is also a slot to which can be removably attached a plug-in board that may be either a desired tone generator plug-in board or a desired effect plug-in board.

Terminal 24 is an analog-in terminal through which analog signals, such as analog tone signals or singing sound signals from a microphone, are input to the main body of the electronic musical instrument 1. Each of the analog signals input via this analog-in terminal 24 is converted by an analog-to-digital (A/D) converter 25 into a digital signal. As will be later described, the thus-converted digital signal is mixed with tone data generated in the main body of the electronic musical instrument 1 and then output from the main body of the electronic musical instrument 1 for audible reproduction through the sound system 4. Another serial I/O 26 is an input/output means which converts serial data, supplied from the A/D converter 25 or first or second slot 22 or 23, into parallel data to transfer the converted parallel data to a mixer 28 and which also converts parallel data, sent from the mixer 28, into serial data to transfer the converted serial data to the first or second slot 22 or 23. The main body of the electronic musical instrument 1 also includes a tone generator device 27 that generates tone signals on the basis of tone generating parameters set in a tone generator register and under the control of the system CPU 10. Any desired tone color can be selected for each tone signal to be generated by the tone generator device 27, by operation of any of the tone-color selecting buttons provided on the panel display and switch section 6, from among main-body preset voices and main-body custom main voices possessed by the tone generator device 27. Data of each selected tone color are set into a tone generation area of the system RAM 12.

The mixer 28 functions to mix, at a set mixing ratio, tone data generated by the tone generator device 27, tone data supplied from the plug-in board 2 or 3 via the serial I/O 26 and tone data processed by a DSP (Digital Signal Processor) 29. This mixer 28 can mix the input tone data of a plurality of channels using a different mixing ratio for each of the channels, so as to output the mixed tone data to the DSP 29. The DSP 29 is capable of performing a filtering process and the like on the tone data of the plurality of channels supplied from the mixer 28. In addition to the filtering process, the DSP 29 can impart an effect, such as reverberation, chorus, variation or distortion, to each of the channels. The DSP 29 can process the tone data of the plurality of channels, and two of these channels are set as output channels coupled to a digital-to-analog (D/A) converter 30. Namely, each of the tone data supplied to these output channels is subjected to the filtering process and the like, then converted via the D/A converter 30 into an analog signal and then audibly reproduced through the sound system 4. Terminal 31 is provided for outputting the analog signal passed from the D/A converter 30.

The following paragraphs describe types of the plug-in boards removably attachable to the first and second slot 22 and 23 in the main body of the electronic musical instrument 1. The plug-in boards can be classified into the following major types.

(1) Mono-part Tone Generator Plug-in Board

Tone generating section of the mono-part tone generator plug-in board, such as the plug-in board 2 shown in FIG. 1, has only a single performance part. According to the MIDI technique, 16 channels can be set per performance part and performance data of the part can be transmitted through each of the MIDI channels. The mono-part tone generator is designed to generate tone signals for one performance part in response to a performance of only one of the MIDI channels. Each of the tone signals output from the mono-part tone generator plug-in board 2 is handled in a similar manner to tone signals of the individual performance parts of the tone generator device 27 in the main body of the electronic musical instrument 1, and can be imparted with any desired one of the various effects by the DSP 29.

(2) Multi-part Tone Generator Plug-in Board

The multi-part tone generator plug-in board is capable of generating tone signals of a plurality of performance parts, which outputs the tone signals of the individual performance parts in mixed condition. In response to inputs from two or more of the 16 MIDI channels, the multi-part tone generator can generate tone signals of the corresponding performance parts.

(3) Effect Plug-in Board

The effect plug-in board, such as the plug-in board 3 attached to the second slot 23 shown in FIG. 1, is capable of imparting a desired effect to an input tone signal. There are two types of the effect plug-in board: an insertion effect plug-in board for imparting a harmony effect or the like to a tone signal of a single performance part; and a system effect plug-in board for imparting a three-dimensional localization effect or the like to a mixed result of tone signals of two or more performance parts.

The mono-part tone generator plug-in board and multi-part tone generator plug-in board at items (1) and (2) above can implement a plurality of different types of tone generators, such as the analog modeling tone generator, FM tone generator, waveform memory tone generator and physical model tone generator, which are designed as the mono-part tone generator or multi-part tone generator depending on the nature of the tone generation scheme employed therein.

Figure 3:
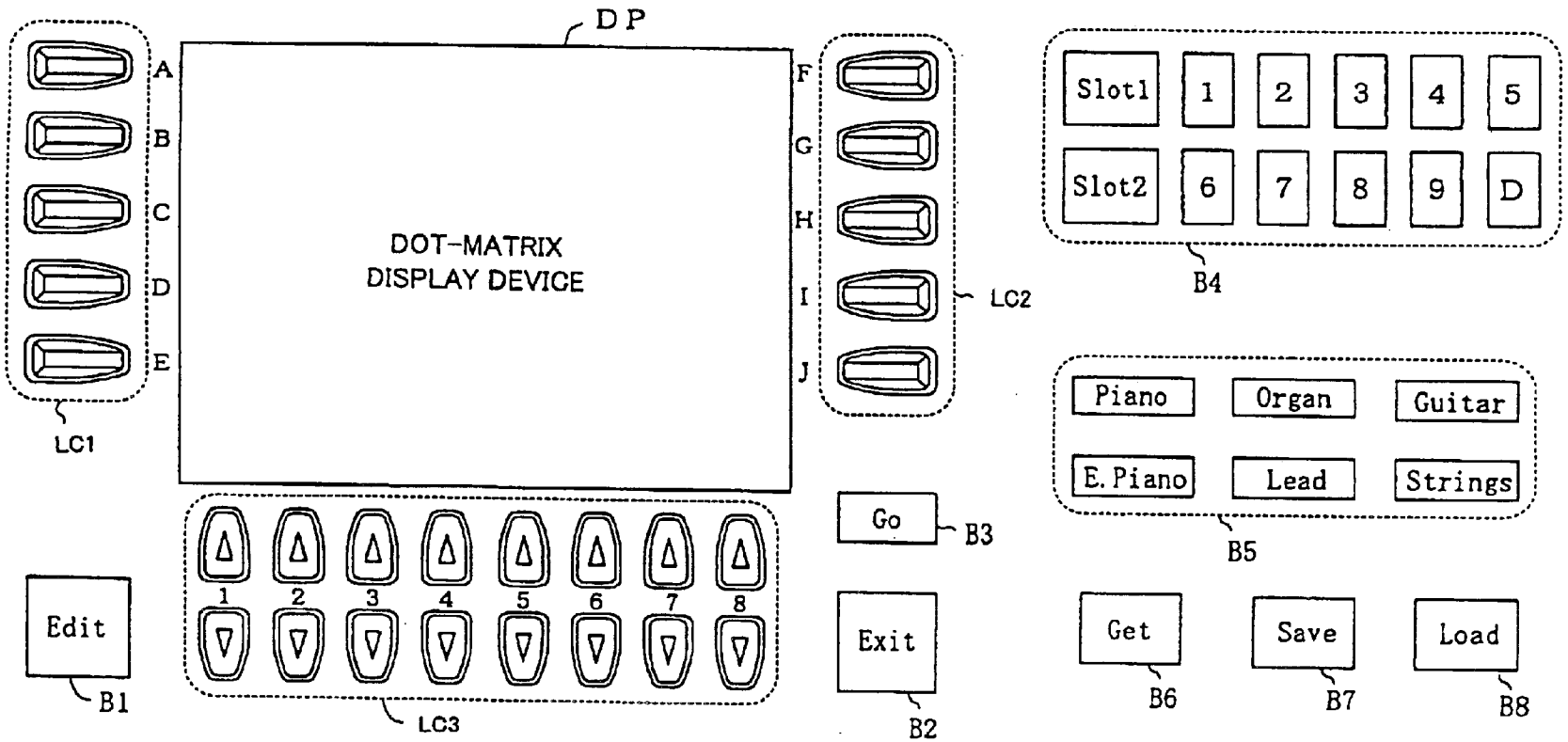
FIG. 3 is a diagram showing a specific configuration of a panel display and switch section associated with a main body of the electronic musical instrument shown in FIG. 1.

FIG. 3 is a diagram showing a specific configuration of the panel display and switch section 6 associated with the main body of the electronic musical instrument 1 shown in FIG. 1.

In FIG. 3, the panel display and switch section 6 includes a dot-matrix display device DP in the form of an LCD (Liquid Crystal Display) or the like. On the dot-matrix display device DP are visually displayed a basic screen as illustratively shown in FIG. 4 and a voice selecting screen as illustratively shown in FIG. 5 or 6. To the left and right of the dot-matrix display device DP, there are provided a first group of LCD buttons LC1 (i.e., five buttons "A"–"E") and a second group of LCD buttons LC2 (i.e., five buttons "F"–"J"). Below the dot-matrix display device DP, there are provided a third group of LCD buttons LC3 (i.e., eight pairs of up-arrow and down-arrow keys "1"–"8"). Furthermore, to the right of the second group of LCD buttons LC2, there is provided a group of board-tone-color selecting buttons B4 operable by the user for allocating or setting, to a desired performance part, any one of board preset voices, board custom voices and plug-in custom voices possessed by the plug-in boards attached to the first and second slots 22 and 23.

The board-tone-color selecting button B4 includes a first slot ("Slot 1") button for selecting the first slot 22, second slot ("Slot 2") button for selecting the second slot 23, selecting buttons "1"–"9" for selecting a desired one of the board preset voices, board custom voices and plug-in custom voices possessed by the tone generator plug-in board, and selecting button "D" for selecting a desired one of the board preset voices and board custom voices. Note that operation or activation of the selecting buttons "1"–"9" can cause a maximum of 20 different tone color names to be displayed so that the user can select any desired one of the displayed 20 tone colors.

Further, below the board-tone-color selecting button group B4, there are provided main-body-tone-color selecting buttons B5 for setting, to a desired performance part, any one of main-body preset voices and main-body custom voices possessed by the main body of the electronic musical instrument 1. The main-body-tone-color selecting buttons B5 includes a piano selecting button for selecting a piano tone color group, organ selecting button for selecting an organ tone color group, guitar selecting button for selecting a guitar tone color group, electronic piano selecting button for selecting an electronic piano tone color group, lead selecting button for selecting a lead tone color group, and a strings selecting button for selecting a strings tone color group.

The panel display and switch section 6 also includes panel switches, such as an Edit button B1 for instructing editing, Exit button B2 for instructing an exit from a current selecting state, Go button B3 for instructing execution of a selected process, Get button B6 for instructing drawing, into the flash ROM 11, of tone color data of the board custom voice possessed by the plug-in board attached to the first or second slot 22 or 23, Save button B7 for instructing saving, of modification data or the like of the board custom voice or plug-in custom voice stored in the flash ROM 11, onto the disk 8 via the disk drive 7, and Load button B8 for instructing loading, into the flash ROM 11, of modification data or the like of the board custom voice or plug-in custom voice stored on the disk 8.

Next, a description will be made about exemplary procedures followed by the user in performing operations of FIGS. 11A to 11F with reference to corresponding screens displayed on the dot-matrix display DP shown in FIGS. 4 to 8.

The following paragraphs first describe exemplary procedures for making a tone color selection to set, to a selected performance part, any one of the main-body preset voices possessed by the tone generator device 27 in the main body of the electronic musical instrument 1. In this case, the user manipulates any one of the second group of LCD buttons LC2 (i.e., "F"–"J" buttons) on the basic screen of FIG. 4, to thereby select a corresponding performance part. On an upper portion of the basic screen of FIG. 4, there are displayed a style, song name and tone color names set to the individual performance parts. In the illustrated example of FIG. 4, four performance parts, i.e. left part, first right part, second right part and third right part, are displayed, to which are set tone color names "Purple Organ", "Bright Piano", "Rock Organ" and "Saw. Lead", respectively. Further, in the illustrated example of FIG. 4, the song name is "SONG_ 001" and the style is "Rock Shuffle".

Figure 5:
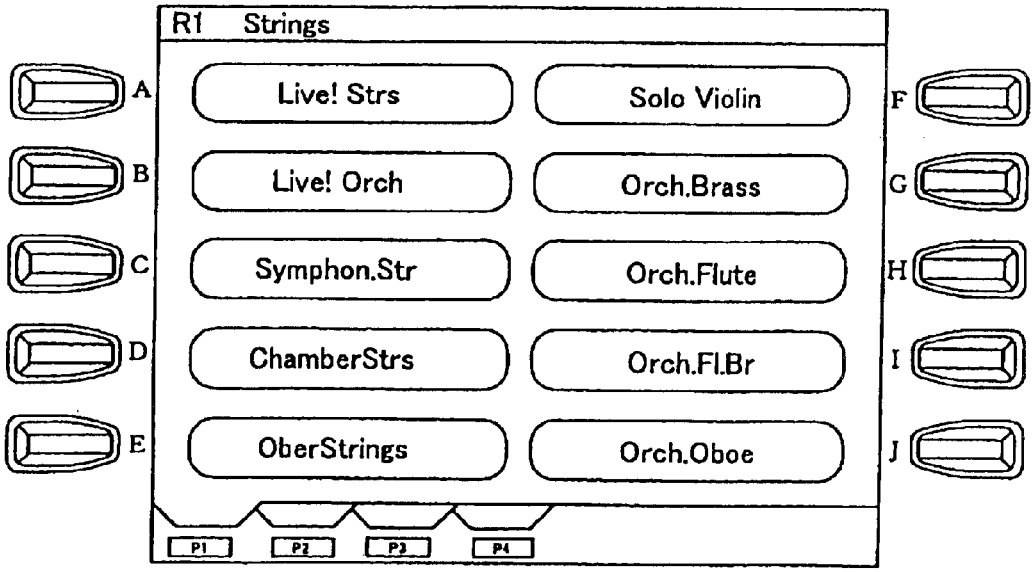
FIG. 5 is a diagram showing a main-body-voice selecting screen displayed on the panel display and switch section.
Figure 11A:
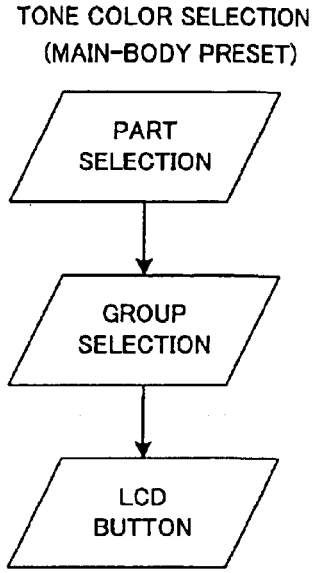
FIGS. 11A to 11F are diagrams explanatory of various operations performed by a user in the main body of the electronic musical instrument.

Then, the user performs a group selection operation, as shown in FIG. 11A, by manipulating any one of the main-body-tone-color selecting buttons B5. Let it be assumed here that the user has operated the "Strings" button from among the main-body-tone-color selecting buttons B5. FIG. 5 shows an example of a screen displayed on the dot-matrix display device DP in response to the user operation of the button. In this case, "R1 Strings" is shown at the top of the screen, which indicates that the screen is for the user to set a tone color of the strings tone color group to the first right part (R1). Then, once the user operates, for example, the "A" button from among the first group of LCD buttons LC1 while the screen is shown, a "Live! Strs" tone color belonging to the strings tone color group is set to the first right part. If the "F" button is operated from among the second group of LCD buttons LC2, then a "Solo Violin" tone color belonging to the strings tone color group is set to the first right part. Assume here that the maximum number of tone colors to be included in the strings tone color group of the main-body preset voice is "40"; each time the user operates one of the third group of LCD buttons LC3 corresponding to pages P1–P4 at the bottom of the screen of FIG. 5, up to ten tone colors of the selected page are displayed on the screen. The screen of FIG. 5 is shown as displaying the names of ten tone colors belonging to page P1.

Note that tone color name information of the main-body preset voice displayed on the dot-matrix display device DP during the tone color selection operation is stored previously in the flash ROM 11 along with corresponding tone color parameters, and a tone color map with the tone color names written therein is created and stored in the flash ROM 11 previously. This tone color map is of a matrix format where the horizontal axis represents program changes while the vertical axis represents bank numbers as described later in relation to FIG. 10. With the tone color map, it is possible to designate a specific tone color name located at an intersecting point defined by one bank number and one program change. Such a tone color map is created as a table per bank select MSB and stored in the flash ROM 11.

Once the tone color selection operation has set or allocate any one of the tone color of the main-body preset voice to the selected performance part, the tone color data corresponding to the bank number and program change of the selected tone color name are read out from the flash ROM 11 with reference to the tone color map table and then written into the tone generation area of the system RAM 12. Thus, in response to occurrence of each performance event of the performance part, the tone generator device 27 generates a tone signal of the tone color selected for that part.

The tone color selection operation for setting any one of the main-body preset voices to the selected performance part can be carried out by a small number of simple procedures (i.e. performance part section, tone color group selection and LCD button manipulation), so that the tone color selection operation for the selected performance part can be executed with ease even during the course of a performance.

Figures 9A, 9B, 9C, 10:
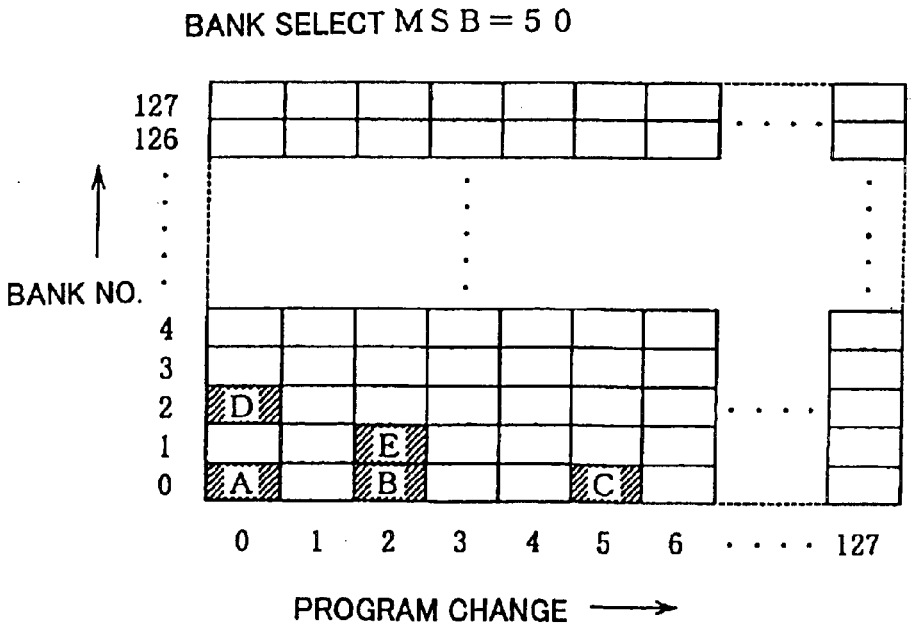
FIGS. 9A to 9C are diagrams showing exemplary organizations of data of individual bank numbers sent from a plug-in board in the embodiment of the tone generation apparatus of the present invention.
FIG. 10 is a diagram showing an example of a tone color map employed in the embodiment of the tone generation apparatus of the present invention.

More specifically, the tone color map indicates, in a matrix format, a plurality of tone color names and the like useable by the main body of the electronic musical instrument 1 to which a desired plug-in board is attachable. Namely, in this tone color map, there are included not only the tone color names of the main-body preset and custom voices possessed by and generatable by the main body of the electronic musical instrument 1 but also the tone color names of the board preset and board custom voices possessed by and generatable by the plug-in board 2. As illustratively shown in FIG. 10, the horizontal axis of the tone color map represents program changes 0–127 while the vertical axis represents bank numbers 0–127, so that it is possible to specify a tone color name located at an intersecting point defined by one bank number and one program change. In the illustrated example of FIG. 10, tone color name "A" can be specified by a combination of bank select "0" and program change "0". Similarly, each of other tone color names "B"–"E" can be specified by a combination of one bank number and one program change. Such a tone color map is created for each bank select MSB—the tone color map shown in FIG. 10 is one created for bank select "50"— and stored as a table in the flash ROM 11. Further, in the tone color map, there are written, in association with the tone color names, device numbers DN each specifying a tone generator possessing the corresponding tone color.

As the device numbers DN, foor numbers "0", "1", "2" and "7" are defined in the instant embodiment; device number "1" is allocated to the plug-in board attached to the first slot 22, device number "2" is allocated to the plug-in board attached to the second slot 23, and device number "7" is allocated to the tone generator device 27 in the main body of the electronic musical instrument 1. There is no tone generator allocated device number "0", and this means that the tone color written along with device number "0" is not supported by any tone generator.

The tone color data of the board custom voices possessed by the plug-in board 2 are stored in the internal volatile memory, i.e. RAM, of the plug-in board 2. Therefore, at powering up of (i.e., turning-on of the power to) the electronic musical instrument, no board custom voice exists and thus can not be used at all. To avoid this inconvenience, the tone generation apparatus of the present invention is arranged to prestore the tone color data of the board custom voices in the non-volatile flash ROM 11, so that unless a plug-in board replacement (i.e., the fact that the inserted or attached plug-in board 2 has been replaced with another plug-in board) is detected at the time of powering up, the tone color data of the board custom voices prestored in the non-volatile flash ROM 11 are written into the RAM of the plug-in board 2. Further, the tone color maps to be used for the tone color selection are also prestored in the non-volatile flash ROM 11, so that any desired one of the tone color maps in the flash ROM 11 can be used unless a plug-in board replacement (i.e., the fact that the inserted or attached plug-in board 2 has been replaced with another plug-in board) is detected at the time of powering up. In case the inserted or attached plug-in board 2 has been replaced with another plug-in board, the tone color information obtained from the other or newly attached plug-in board 2 is written into the flash ROM 11 upon powering up, to thereby update the tone color maps. Thus, immediately after the powering up, a selection can be made from among the tone colors possessed by the plug-in board, using the updated tone color maps.

Note that when the tone color information is to be loaded from the plug-in board 2 into the flash ROM 11, it is sent out as data corresponding to individual bank numbers. Examples of such data corresponding to individual bank numbers are shown in FIGS. 9A to 9C. More specifically, FIG. 9A shows data of which the bank number Bank is "0" and which constitute tone color name information representative of tone colors possessed by the plug-in board 2 attached to the first slot 22; therefore, in this case, the device number DN has been set to "1" indicating the first slot 22. Further, in this case, the bank select MSB has been set to "50". The data of bank number "0" comprise 128 different data corresponding to program changes 0–127. Each of the 128 data has been set to a value of either "1" or "0". The data "1" indicates that the plug-in board 2 attached to the first slot (DN=1) possesses the tone color specified by the program change for the bank number, while the data "0" indicates that the plug-in board 2 attached to the first slot (DN=1) does not possess the tone color specified by the program change in the bank number, i.e. that the tone color is not supported by the plug-in board 2. Namely, if the tone color information comprises such data as shown in FIGS. 9A to 9C, this means that the plug-in board 2 attached to the first slot (DN=1) possesses tone colors of program changes "0", "2" and "5" for bank number "0", tone color of program change "2" for bank number "1" and tone color of program change "0" for bank number "2" but does not support any other tone color. Tone color map created in accordance with the data shown in FIGS. 9A to 9C corresponds to the one shown in FIG. 10. Here, it is assumed that the tone colors whose bank select MSB is "50" are possessed or supported only by the plug-in board 2; FIG. 10 shows tone colors "A" to "E" supported by the plug-in board 2 attached to the first slot (DN=1).

Note that what can be updated upon turning-on of the main body of the electronic musical instrument 1 are not only the tone color maps but also a table of tone color parameter names. The tone color parameter names are information that is displayed on the dot-matrix display device DP when a later-described tone color editing operation is performed. In updating the tone color parameter names, a determination is made as to whether a plug-in board replacement has taken place. If such a plug-in board replacement has not taken place, the table of tone color parameter names stored in the flash ROM 11 is used as it is. If, on the other hand, a plug-in board replacement has taken place, the table of tone color parameter names is loaded from the other or newly inserted plug-in board into the flash ROM 11 so as to update the table of tone color parameter names in the flash ROM 11. Thus, the names of the tone color parameters possessed by the plug-in board can be displayed immediately after the powering up.

Figure 11B:
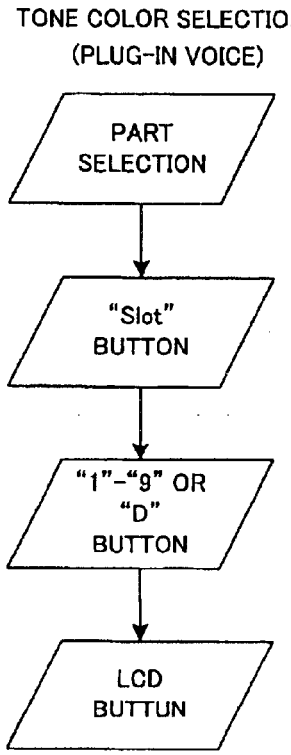

The following paragraphs describe a tone color selection operation of FIG. 11B that is performed by the user for setting, to a selected performance part, any one of board preset and board custom voices possessed by a tone generator plug-in board attached to the main body of the electronic musical instrument 1 and plug-in custom voices obtained by editing the board preset and board custom voices.

Figure 4:
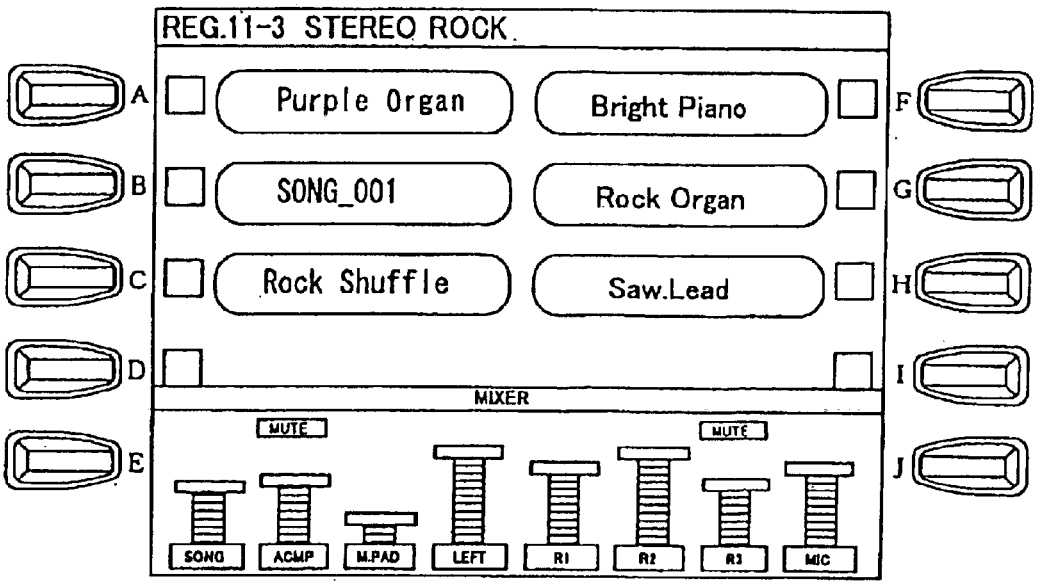
FIG. 4 is a diagram showing a basic screen displayed on the panel display and switch section associated with the main body of the electronic musical instrument.

In the tone color selection operation, the user manipulates any one of the "F"–"J" buttons in the second group of LCD buttons LC2 on the basic screen of FIG. 4, to thereby select a corresponding performance part. Then, the user operates any one of the board-tone-color selecting buttons B4. If one of the tone colors possessed by the plug-in board attached to the first slot 22 is to be set to the selected performance part, the user first operates the "slot 1" button of FIG. 3 and then any one of the "1"–"9" buttons and "D" button. If, on the other hand, one of the tone colors possessed by the plug-in board attached to the second slot 23 is to be set to the selected performance part, the user first operates the "slot 2" button of FIG. 3 and then any one of the "1"–"9" buttons and "D" button. In case, however, either one of the "slot 1" and "slot 2" buttons has already been in a selected state and may remain in the selected state, it is not necessary to again operate the same button. Note that the "1"–"9" buttons are for selecting any one of the board preset and board custom voices possessed by the plug-in board, and the voice selected via one of the "1"–"9" buttons can be subjected to offset editing in the main body of the electronic musical instrument 1 as will be later described. Voices of up to 20 different tone colors can be allocated to each one of the "1"–"9" buttons, and any one of the allocated voices can be selected. Further, the "D" button is for selecting any one of the board preset and board custom voices possessed by the plug-in board, and the voice selected via the "D" button can not be edited in the main body of the electronic musical instrument 1. Desired number of voices from among the voices possessed by the plug-in board can be allocated to the "D" button, and any one of the allocated voices can be selected.

Figure 6:
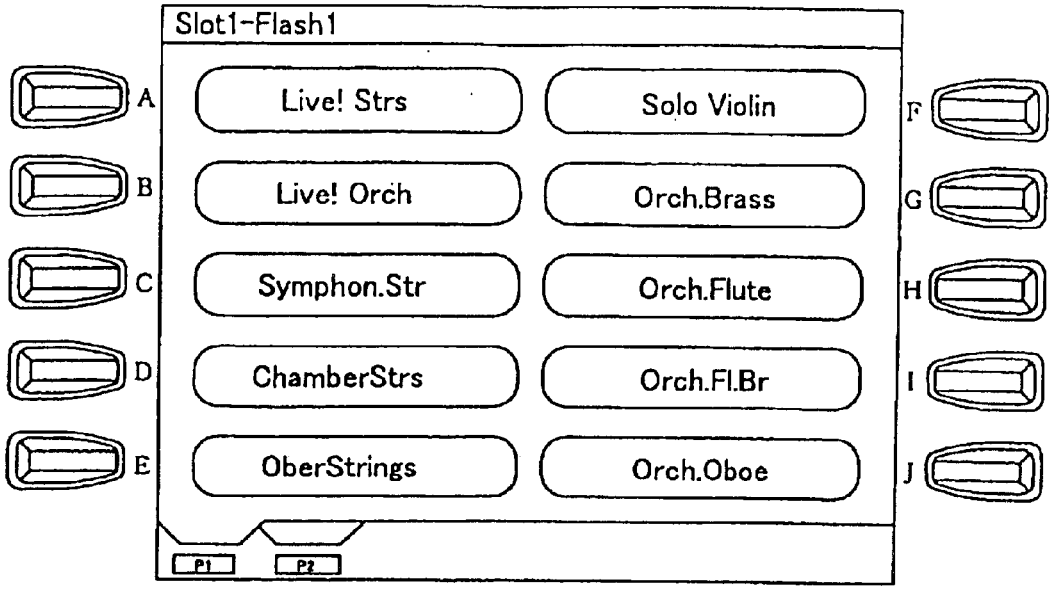
FIG. 6 is a diagram showing a plug-in-board voice selecting screen displayed on the panel display and switch section.

In the illustrated example of FIG. 1, the plug-in board 2 is inserted in or attached to the first slot 22. Thus, let's assume here that the user has operated the "slot 1" button to select the first slot and then "1" button in the button group B4 of FIG. 3. In this case, the names of the tone colors allocated to the "1" button are displayed on the dot-matrix display device DP, as illustratively shown in FIG. 6. Namely, "Slot1-Flash" is displayed at the top of the screen of FIG. 6, which indicates that a selection is to be made from among the board custom voices possessed by the plug-in board 2 attached to the first slot 22. Then, once the user operates, for example, the "B" button from among the first group of LCD buttons LC1 while the screen is shown, a tone color "Live! Orch" of the board custom voice is set to the selected performance part. If the "G" button is operated from among the second group of LCD buttons LC2, then a tone color "Orch. Brass" belonging to the board custom voice is set to the performance part. Assume that the maximum number of tone colors capable of being allocated to each of the "1"–"9" buttons in the board-tone-color selecting button group B4 is "20"; each time the user operates one of the third group of LCD buttons LC3 corresponding to pages P1 and P2 at the bottom of the screen of FIG. 6, up to ten tone colors of the selected page are displayed on the screen. The screen of FIG. 6 is shown as displaying the names of ten tone colors belonging to page P1.

Note that the tone color names of the board preset and board custom voices possessed by the tone generator plug-in board, displayed on the dot-matrix display device DP at the time of the tone color selection operation, are the same tone color names as written in the tone color map stored in the flash ROM 11.

"Bank number plus program change" information of the tone colors allocated to the "1" to "9" buttons in the board-tone-color selecting button group B4 is stored in button-specific tone-color-allocation-information storage areas which are provided in the flash ROM 11 in association with the first and second slots and in corresponding relation to the "1" to "9" buttons. Once any one of the tone colors of the board preset and board custom voices displayed on the dot-matrix display device DP is set to the selected performance part through the above-mentioned tone color selection operation, the "bank number plus program change" information corresponding to the selected tone color name, stored in the flash ROM 11, is sent to the plug-in board 2 attached to the first or second slot. If the first slot 22 has been selected, the bank number and program change corresponding to the selected tone color name are sent to the plug-in board 2 attached to the first slot 22.

In the plug-in board 2, tone color data corresponding to the bank number and program change are read out from the internal ROM or RAM and written into the tone generation area of the RAM. If the selected tone color is one of the plug-in custom voice tone colors edited by adding modification data to the tone color data, the modification data is stored, along with the "bank number plus program change" information, in the corresponding button-specific tone-color-allocation-information storage area of the flash ROM 11, so that this modification data is also sent to the plug-in board 2. Then, corresponding parameters in the tone color data represented by the "bank number plus program change" information are modified in accordance with the modification data and then written into the tone generation area of the RAM. Thus, in response to occurrence of each performance event of the performance part, the plug-in board 2 generates a tone signal with the tone color designated for that part.

The tone color selection operation for setting any one of the voices possessed by the tone generator plug-in board to the selected performance part can be carried out by a small number of simple procedures (i.e. performance part section, slot selection, manipulation of one of the "1"–"9" and "D" buttons and LCD button manipulation), so that the tone color selection operation for the selected performance part can be executed with ease even during a performance.

In the case of the mono-part tone generator, such as the plug-in board 2 shown in FIG. 1, the tone color can be set to only one performance part. That is, the tone color possessed by the plug-in board 2 can not be set to the selected performance part when the tone color is being used for another performance part. To avoid this inconvenience, the tone generation apparatus of the present invention is arranged such that where the selected tone color is the tone color of the mono-part tone generator and when the selected tone color has already been set to another performance part than the selected performance part, it inhibits the other performance part from using the tone color and then newly setting the tone color of the mono-part tone generator to the selected performance part. In this case, if there is any appropriate tone color to substitute for the tone color of the mono-part tone generator having been set in the other performance part, then the substitute tone color is allocated to the other performance part; otherwise, the tone generation in the other performance part is muted. In the illustrated example of FIG. 1, the substitute tone color is selected from among the tone colors possessed by the tone generator device 27, and the tone generator device 27 is caused to generate tone signals of the other performance part in place of the mono-part tone generator plug-in board 2. However, in the event that the other performance part, to which the selected tone color is currently set, is a manual performance part to be played on the keyboard 5, the tone color of the manual performance part is not changed, but the substitute tone color for the selected tone color is set to the newly selected performance part. In case there is no substitute tone color, tone generation in the newly selected performance part is muted. This is because it is not preferable to change the tone color of the manual performance part during the course of the performance.

Note that in inhibiting the other performance part from using the tone color and then newly setting the tone color of the mono-part tone generator to the selected performance part as above, an "OK?" inquiry may be displayed on the screen to ascertain whether or not the user agrees to such a tone color setting.

Examples of the plug-in boards prepared for the tone generation apparatus may include one which is equipped with a sequenced voice. The "sequenced voice" is a voice whose tone color data include, in addition to ordinary data such as those indicative of a waveform shape, pitch variations and tone volume envelope variations, pattern data, such as arpeggio pattern data, that indicate respective relative tone pitches, tone generation timing and duration of a plurality of notes. When such a sequenced voice is selected, a plurality of note-on/note-off events corresponding to the pattern data would occur in response to a tone generation (note-on) instruction. In this case, if the sequenced voice is a tone color of the attached plug-in board and when performance data of a performance part for which that tone color has been selected are supplied from the MIDI-IN terminal 17 directly to that plug-in board, tones would be performed by the plug-in board at timing specific to the plug-in board. Namely, the tone generation by the plug-in board would not synchronize with the tone generation by the tone generator device 27 in the main body of the electronic musical instrument 1. Thus, the tone generation apparatus of the present invention is arranged to combine or merge MIDI signals input via the MIDI-IN terminal 17 and MIDI signals generated by the main body of the electronic musical instrument 1, so as to supply the merged MIDI signals to the plug-in board. This arrangement permits synchronization between performances by the plug-in board and main body of the electronic musical instrument 1. Further, when an automatic performance/automatic accompaniment is to be executed by the main body of the electronic musical instrument 1, the tone generation apparatus of the present invention supplies the plug-in board with tempo clock pulses for the automatic performance/automatic accompaniment. With this arrangement, the pattern of the sequenced voice performed by the plug-in board is allowed to synchronize with the automatic performance/automatic accompaniment executed by the main body of the electronic musical instrument 1.

Figure 11C:
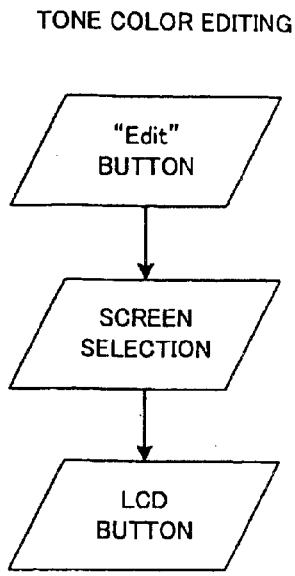

The following paragraphs describe a tone color editing operation of FIG. 11C that is performed by the user for offset-editing a desired one of the board preset and board custom voices possessed by the plug-in board.

Prior to the description of the tone color editing operation, a description is given about tone color editing performed in the main body of the electronic musical instrument 1. The main body of the electronic musical instrument 1 is arranged to edit the tone color by adding modification data to tone color parameters without changing tone color parameter values stored in the tone color data storage areas of the ROM or RAM of the attached plug-in board. Namely, when a particular tone color parameter to be changed has been selected, from among a plurality of tone color parameters constituting a set of tone color data, and then modified, data indicative of a modified amount (hereinafter referred to as "modification data") is retained without the value of the tone color parameter being changed. Then, when the tone color has been selected through manipulation of any one of the "1" to "9" buttons in the board-tone-color selecting button group B4, the edited tone color parameter is obtained which has been edited by causing the modification data to be reflected in the original tone color parameter. Such an editing operation is called "offset editing", and each tone color edited by the offset editing is called a "plug-in custom voice". Such offset editing can be performed even in a case where the plug-in board has no RAM. Note that the modification data is stored as an addition to the "bank number plus program change" information corresponding to the edited tone color stored in one of the button-specific tone-color-allocation-information storage areas (corresponding to the "1"–"9" buttons) of the flash ROM 11 which are provided in association with the first and second slots (i.e., as a combination of bank number plus program change plus modification data). That is, the plug-in custom voice can be selected only by manipulation of one of the "1" to "9" buttons in the board-tone-color selecting button group B4. Therefore, the plug-in custom voice can be selected only by the human player of the main body of the electronic musical instrument 1; the plug-in custom voice can not be selected by the conventional approach of referring to the tone color map in accordance with the "bank number plus program change" information input via the MIDI-IN terminal 17.

Editing a tone color parameter value itself can be performed, for example, via the personal computer 9 connected to the main body of the electronic musical instrument 1, and tone color data including the tone color parameter edited via the personal computer 9 can be loaded from the personal computer 9 into the RAM of the plug-in board. Each tone color thus edited via the personal computer 9, which is called a "board custom voice", can be selected by the player of the main body of the electronic musical instrument 1 manipulating a corresponding one of the buttons in the board-tone-color selecting button group B4, or by referring to the tone color map on the basis of the "bank select plus program change" information input via the MIDI-IN terminal 17.

Note that the modification data in the offset editing is retained, during the offset editing, in a working area of the system RAM 12 in association with the tone color name information of the edited tone color. The tone color name of the edited tone color can be changed to a desired tone color name, and the modification data with or without the tone color name changed is stored as an addition to the "bank number plus program change" information corresponding to the edited tone color stored in one of the button-specific tone-color-allocation-information storage areas (corresponding to the "1"–"9" buttons) of the flash ROM 11 which are provided in association with the first and second slots (i.e., as bank number plus program change plus modification data). That is, where the edited tone color is a voice custom voice, this voice custom voice is replaced with a plug-in custom voice. Thus, the plug-in custom voice, which is the offset-edited tone color, can be selected through manipulation of one of the "1" to "9" buttons in the board-tone-color selecting button group B4.

Referring back to FIG. 11C, a description will be made about the tone color editing operation for offset-editing a board preset voice or board custom voice possessed by a plug-in board.

Figure 7:
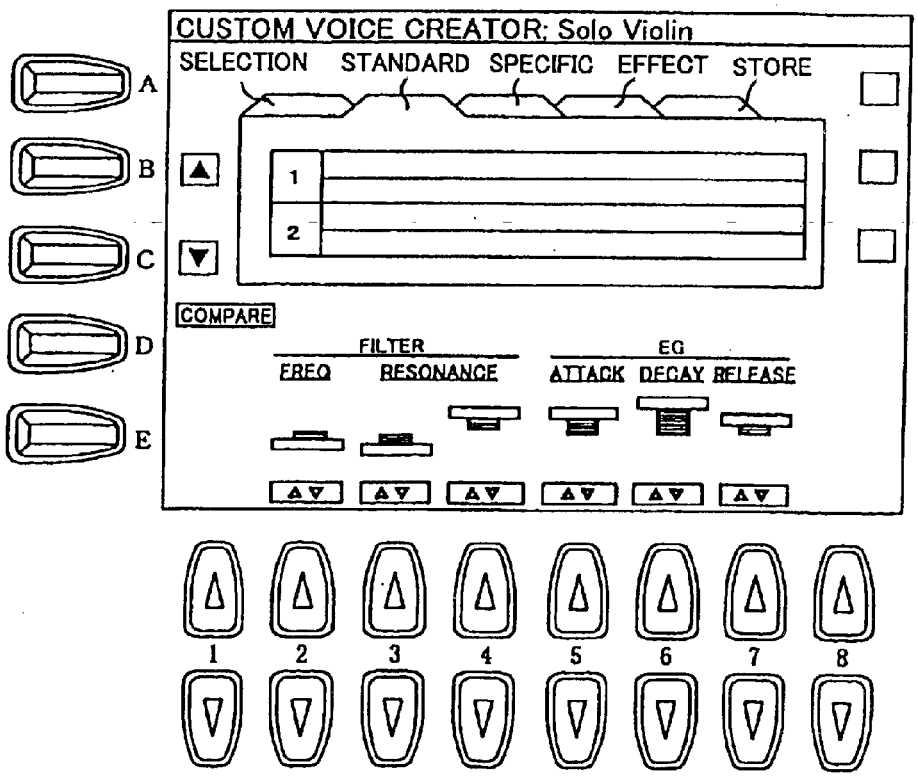
FIG. 7 is a diagram showing a standard-parameter editing screen displayed on the panel display and switch section.

For the tone color editing operation, the user operates the Edit button B1 shown in FIG. 3, in response to which a screen of a custom voice creator is displayed on the dot-matrix display device DP as shown in FIG. 7. "CUSTOM VOICE CREATOR: Solo Violin" is displayed at the top of this screen, which indicates that the tone color of the tone color name "Solo Violin" is selected and edited. On the custom voice creator screen, there can be displayed any one of a "tone color section" window, "effect parameter" window, "standard parameter" window, "specific parameter" window, "effect parameter" window and "store" window. By selecting and displaying the "tone color section" window, it is possible to select a tone color name to be offset-edited. When this "tone color section" window is selected, the tone color names allocated to the "1"–"9" buttons in the board-tone-color selecting button group B4 in association with each of the first and second slots are displayed in the "tone color section" window. Because up to 20 tone colors can be allocated to each one of the "1"–"9" buttons, a maximum of 180 tone color names can be displayed in the tone color section" window for each of the first and second slots.

In the illustrated example of FIG. 7, the "standard parameter" window is displayed on the screen; the standard parameters are common parameters for a tone generator that has no relation to the type of the tone generator constructed on the plug-in board. Of the standard parameters shown in FIG. 7, first parameters are a filter cut-off frequency parameter FREQ and filter resonance parameter RESONANCE, and second parameters are an attack parameter ATTACK, decay parameter DECAY and release parameter RELEASE for an envelope generator (EG). Current settings of these standard parameters are indicated in a bar graph below the parameter listing. Each of these parameter settings can be changed as desired by operating any one of the up-arrow and down-arrow keys of the "2"–"7" LCD buttons. For example, the filter cut-off frequency parameter FREQ is editable within a range of −64 to +64; if the filter cut-off frequency parameter FREQ has been edited to "+3" through manipulation of the second LCD button group LC2, then "+3" becomes modification data in the offset editing. This modification data is retained in the system RAM 12 in association with offset-edited tone color name "Solo Violin". Other parameters can be offset-edited in a similar manner. The standard parameters include other parameters than the above-mentioned first and second parameters, which can be caused to show up by manipulating the "C" button in the first LCD button group LC1 to scroll up the screen; the screen can be scrolled down by manipulation of the "B" button in the first LCD button group LC1.

Figure 8:
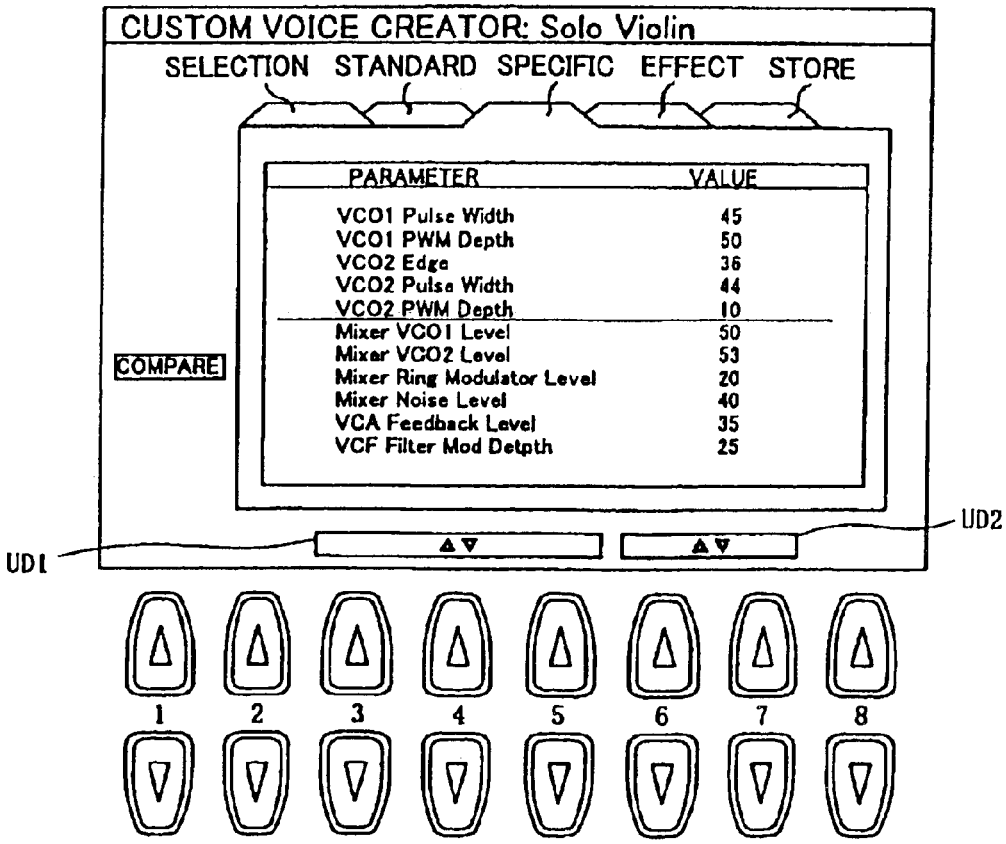
FIG. 8 is a diagram showing a specific-parameter editing screen displayed on the panel display and switch section.

FIG. 8 shows the "specific parameter" window displayed on the dot-matrix display device DP by manipulation of the first LCD button group LC1. The specific parameters are parameters specific to a tone generator type of a plug-in board attached to the first or second slot. In FIG. 8, there are shown specific parameters for an analog modeling tone generator modeled after an analog synthesizer. In the illustrated example of FIG. 8, a parameter "VC02 PWM Depth" is underlined, which means that the parameter "VC02 PWM Depth" has been selected to be made editable. In this state, the value of the "VC02 PWM Depth" can be modified to be offset-edited by manipulation of the up-arrow key or down-arrow key of the "6" button or "7" in the third LCD button group LC3 corresponding to an up/down mark UD2. If "VALUE" is changed from "10" to "15", "+5" becomes modification data in the offset editing. This modification data is retained in the system RAM 12 in association with offset-edited tone color name "Solo Violin". Other parameters can also be offset-edited in a similar manner. To select a desired one of the other parameters, it is only necessary to manipulate the up-arrow key or down-arrow key of the "4" LCD button corresponding to an up/down mark UD1.

Note that the parameter names displayed on the dot-matrix display device DP at the time of the tone color editing are the parameter names of the board preset and board custom voices possessed by the plug-in board, and can be loaded from the plug-in board into the flash ROM 11 upon powering up of the main body of the electronic musical instrument 1 as previously mentioned. Further, if the plug-in board so far inserted has not been replaced with another plug-in board (i.e., no plug-in board replacement is detected) at the time of powering up, the table of parameter names of the board preset and board custom voices possessed by the plug-in board, currently stored in the flash ROM 11, is used as it is, without the parameter names having to be loaded from the plug-in board into the flash ROM 11. The thus-obtained parameter names are displayed on the dot-matrix display device DP at the time of the tone color editing operation. Also note that the parameter values to be displayed along with the parameter names are obtained by making an inquiry to the corresponding plug-in board when the parameter names are to be displayed.

Further, if the "effect parameter" window has been displayed through manipulation of the first group of LCD buttons LC1, a performance part to which an effect to be imparted is selected, and the effect to be imparted to the part can be edited, although not specifically shown. In the effect editing operation, a desired one of various effects, such as reverberation, chorus, variation and distortion, can be edited.

Further, if the "store parameter" window has been displayed through manipulation of the first group of LCD buttons LC1, it is possible to store each edited data obtained by editing the standard or specific parameter on the screen, namely, modification data of the plug-in custom voice. In this case, the modification data can be stored with or without the names of the offset-edited tone colors updated. Also, each of the edited effect parameters can be stored into the flash ROM 11.

Figure 11D:
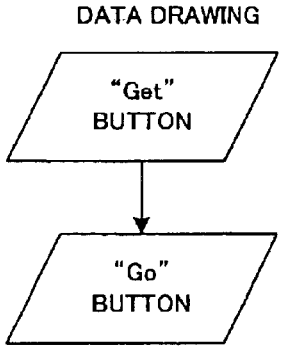

The following paragraphs describe a data drawing operation of FIG. 11D that is performed by the user for drawing the tone color data of the board custom voice, possessed by the plug-in board, to the flash ROM 11 of the main body of the electronic musical instrument 1.

For the operation to draw the tone color data of the board custom voices, possessed by the plug-in board, to the flash ROM 11, the user activates the Get button B6 of FIG. 3. In response to the activation of the Get button B6, an inquiry "OK ?" is displayed on the dot-matrix display device DP to ask the user whether the user wants to proceed to the data drawing operation. Then, once the user activates the Go button B3, the tone color data of the board custom voice start being drawn from the plug-in board to the flash ROM 11. In this case, the board custom voice is originally stored in the RAM of the plug-in board 2, and after the board custom voice storage area of the flash ROM 11 is cleared, the tone color data of the board custom voice read out from the plug-in board RAM are written into the board custom voice storage area of the flash ROM 11.

It is preferable that the above-mentioned data drawing operation be performed when the board custom voice has been loaded from the personal computer or the like into the RAM of the plug-in board 2. This arrangement allows a latest board custom voice to be stored and also used, by updating the tone color map with the tone color name information of the latest board custom voice.

Figure 11E:
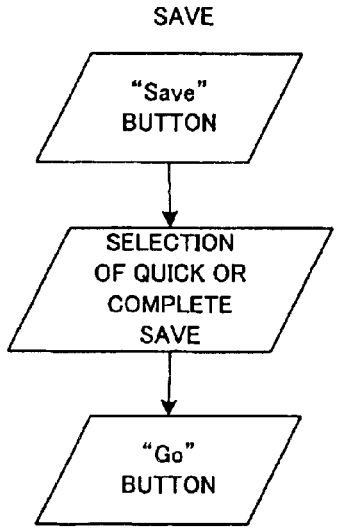
Figure 11F:
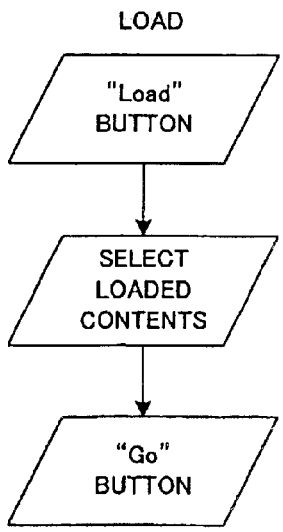

The following paragraphs describe a data saving operation of FIG. 11E that is performed by the user for saving, onto the disk 8 installed in the disk drive 7, the tone color data of the board custom voice of the plug-in board stored in the flash ROM 11 and the modification data of the plug-in custom voice.

The user activates the Save button B7 of FIG. 3 when the tone color data of the board custom voice of the plug-in board stored in the flash ROM 11 and the modification data of the plug-in custom voice are to be saved onto the disk 8. In response to the activation of the Save button B7, a screen for selecting either "quick save" or "complete save" is displayed on the dot-matrix display device DP. If the "quick save" is selected by the user, the modification data of the plug-in custom voices, style data, etc., other than the tone color data of the board custom voices of the plug-in board, stored in the flash ROM 11 are saved onto the disk 8 installed in the disk drive 7. If, on the other hand, the "complete save" is selected by the user, then the tone color data of the latest board custom data stored in the plug-in board RAM are first transferred to the flash ROM 11 and then saved onto the disk 8 in the disk drive 7 along with the modification data of the plug-in custom voice, style data, etc. The reason for rewriting the tone color data of the board custom voice stored in the flash ROM 11 to the tone color data of the board custom voice residing in the RAM of the plug-in board is that they are not necessarily the same as the tone color data of the board custom voice in the flash ROM 11.

In case the user wants to cancel any one of the above-described user operations, the user operation can be canceled by the user activating the Exit button B2.

Figure 12:
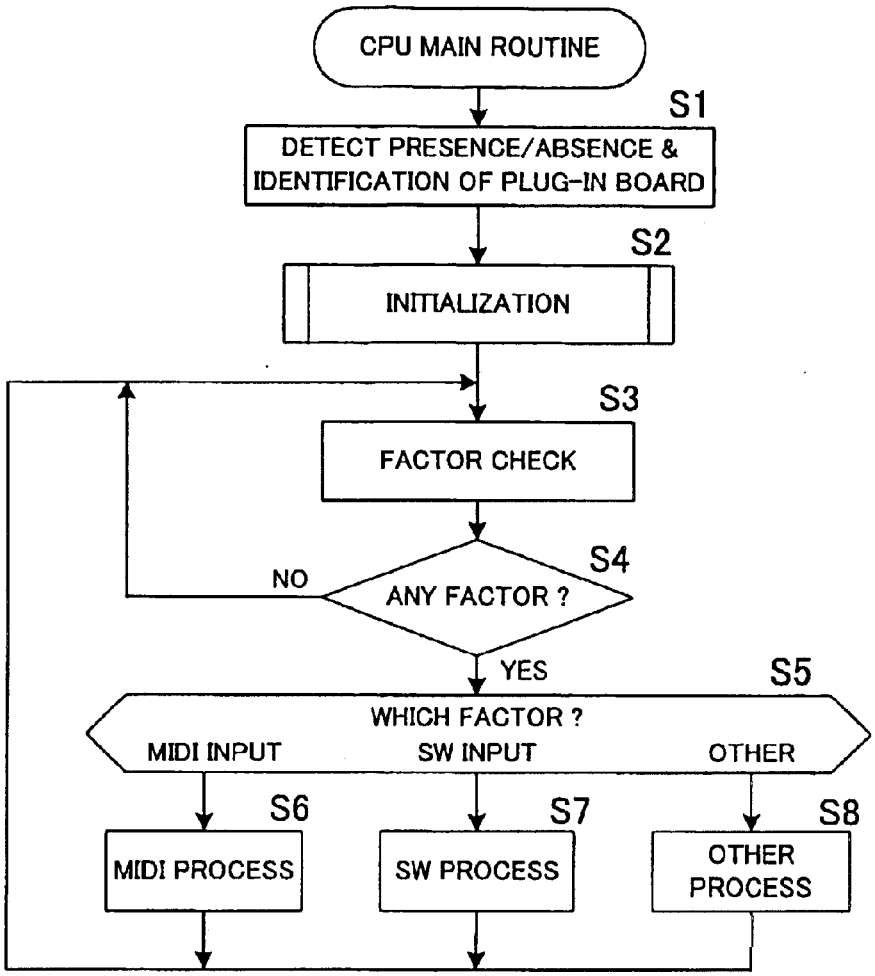
FIG. 12 is a flow chart showing an exemplary operational sequence of a CPU main routine carried out by a system CPU in the main body of the electronic musical instrument.

Now, a description will be made about a CPU main routine carried out by the System CPU 10 in the main body of the electronic musical instrument 1, with reference to FIG. 12.

The CPU main routine is started up upon powering up of the main body of the electronic musical instrument 1. Then, at step S1, a determination is made as to wether or not plug-in boards are currently inserted in or attached to the first and second slots of the main body, and if it is determined that plug-in boards are currently inserted in or attached to the first and second slots, types and other identification information of the attached plug-in boards are detected. In this case, the information of the plug-in board attached to the first slot 22 with the device number DN set to "1" is first detected, and then the information of the plug-in board attached to the second slot with the device number DN set to "2" is detected. Here, the detected types and identification information of the attached plug-in boards are stored into the system RAM 12. If the attached plug-in board is a tone generator plug-in board, it is further determined which of mono-part and multi-part tone generators the attached plug-in board is, and detection is made of selectable tone color numbers (bank select MSB plus bank number plus program change). If the attached plug-in board is an effect plug-in board, selectable effect numbers are detected.

Note that the detection of the plug-in boards and initialization process based on the detection results may be performed at the time of the plug-in board's attachment to the slots or on a periodic basis, rather than in response to the powering up of the main body of the electronic musical instrument 1, so as to keep the environment of the main body of the electronic musical instrument 1 in a latest or up-to-date condition.

After that, the initialization process is carried out at step S2. In this initialization process, as will be described in detail, a determination is made as to whether any one of the plug-in boards attached to the first and second slot is a newly-inserted plug-in board. If any one of the plug-in boards has been determined as a newly-inserted plug-in board, tone color name information and tone color parameter name information is obtained from the newly-inserted plug-in board, and then the tables of tone color names and tone color parameter names are updated on the basis of the thus-obtained tone color name information and tone color parameter name information. Upon completion of the initialization process, a factor check is performed at next step S3, and then a determination is made at step S4 as to whether or not there has occurred any cause or factor to execute a process. Here, examples of such a factor include input of a MIDI signal from the MIDI-IN terminal 17 or keyboard 5, and occurrence of an event such as manipulation of any one of the switches and buttons on the panel display and switch section 6 and other kind of event. The System CPU 10 waits until it is determined that there has occurred such a processing factor.

Once a MIDI signal has been input from the MIDI-IN terminal 17 or keyboard 5 and hence it has been determined that there has occurred a processing factor, the factor is identified as "MIDI input", so that the System CPU 10 branches to step S6. At step S6, an event process corresponding to the input MIDI signal is carried out. For example, if the input MIDI signal is a note-on event signal, a tone generating instruction is given to the tone generator device 27 or plug-in board 2 that generates a tone signal for a performance part designated by the note-on event data. If, on the other hand, the input MIDI signal is a note-off event signal, the tone generator device 27 or plug-in board 2 is instructed to start sounding a release phase of a corresponding tone signal in response to the input note-off event signal. Further, if there has been input a MIDI signal for a performance part set to be performed on the plug-in board 2, control is performed to present the main body of the electronic musical instrument 1 from generating a corresponding tone. Furthermore, if the input MIDI signal is a control input, such as one for controlling a performance part tone volume or effect balance, the mixer 28 and the like controls a corresponding mixer channel. Moreover, if the input MIDI signal is an effect control instruction, a change is made to microprograms and coefficients set in the DSP 29 and corresponding mixer channel. However, in the case where the plug-in board 2 is an effect plug-in board, the main body of the electronic musical instrument 1 is caused to not perform control with respect to a control instruction that should be dealt with by the effect plug-in board.

When an affirmative (YES) determination is made at step S4 due to activation of any one of the switches and buttons on the panel display and switch section 6, the factor is identified as "switch input", so that the system CPU 10 branches to step S7. At step S7, there is carried out a switch process which corresponds to the screen currently displayed on the panel display and switch section 6 and any one of the buttons in the first to third LCD button groups and buttons B1–B8 activated at that time. For example, editing is performed in accordance with an editing instruction input by button activation on the panel display and switch section 6. In the event that an instruction has been given for editing tone color data or effect data possessed by the main body of the electronic musical instrument 1, a change is made directly to the designated data. If, on the other hand, an instruction has been given for editing tone color data or effect data possessed by the plug-in board, offset-editing modification data is sent to the plug-inboard, so that the internal CPU of the plug-inboard generates parameters edited with the modification data reflected in the corresponding parameter.

Further, when an affirmative (YES) determination is made at step S4 due to occurrence of another kind of factor, the factor is identified as "other factor", so that the system CPU 10 branches to step S8. At step S8, other processing is performed for controlling variations over time of tone characteristics, such as panning or vibrato variation over time, and/or for executing an automatic performance/accompaniment. Further, at step S8, there may be carried out a process for monitoring a tone volume of each channel currently generating a tone, truncating-order determining process, etc. which are normally executed for tone assignment purposes while the system CPU is available.

Figure 13:
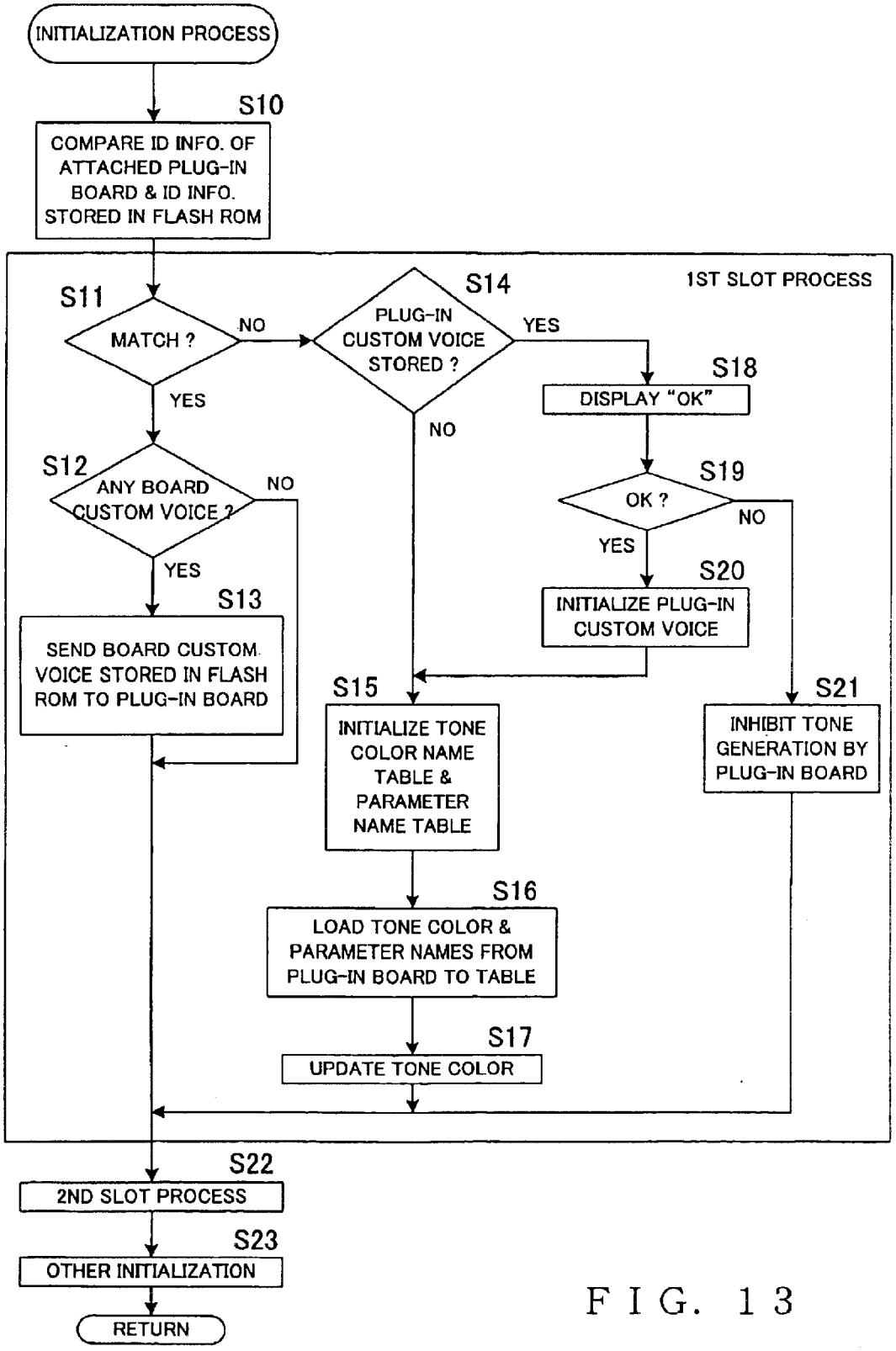
FIG. 13 is a flow chart showing an exemplary operational sequence of an initialization process carried out during the CPU main routine.

The following paragraphs describe an initialization process carried out at step S2 during the CPU main routine, with reference to a flow chart of FIG. 13.

Upon completion of the operation at step S1 of the CPU main routine, the initialization process is started up, where a comparison is made at step S10 between the type and identification information of the attached plug-in board detected at step S1 above and the type and identification information of the plug-in board stored in the flash ROM 11. Then, a first slot process is carried out at steps S11 to S21. On the basis of the comparison at step S10, a determination is made, at step S11 of the first slot process, as to whether the type and identification information of the attached plug-in board in the first slot 22 matches with the type and identification information of the plug-in board currently stored in the flash ROM 11. If the type and identification information of the attached plug-in board in the first slot 22 matches with the type and identification information of the plug-in board currently stored in the flash ROM 11 as determined at step S11, it is judged that no plug-in board replacement has taken place, so that the system CPU 10 moves on to step S12. At step S12, a further determination is made as to whether the plug-in board attached to the first slot 22 has any board custom voice. If tone color data are stored in the board-custom-voice storage area of the flash ROM 11 corresponding to device number "1", an affirmative (YES) determination is made at step S12, so that the system CPU 10 proceeds to step S13. At step S13, the tone color data of the board custom voice read out from the board-custom-voice storage area of the flash ROM 11 corresponding to device number "1" are sent to the plug-in board attached to the first slot 22 and written into the RAM within the plug-in board. With this arrangement, any one of the tone colors of the board custom voice can be set to and sounded in any selected performance part immediately after turning-on of the power. The board custom voice is a plug-in board tone color edited via the personal computer or the like connected to the main body of the electronic musical instrument 1, and heretofore such a board custom voice could not be used unless it was transferred from the personal computer or the like to the RAM of the plug-in board after turning-on of the power.

If there is no board custom voice as determined at step S12 above, the operation at step S13 is skipped.

If, on the other hand, the type and identification information of the attached plug-in board in the first slot 22 does not matched with the type and identification information of the plug-in board currently stored in the flash ROM 11 as determined at step S11, it is judged that a plug-in board replacement has taken place, so that the system CPU 10 moves on to step S14. At step S14, a further determination is made as to whether there is stored, in the flash ROM 11, a plug-in custom voice corresponding to device number "1". In the case where there is stored, in the flash ROM 11, offset-editing modification data corresponding to device number "1", it is judged that there is such a plug-in custom voice, and the system CPU 10 goes to step S18, where an inquiry "OK ?" is displayed on the dot-matrix display device DP to ask the user whether or not the plug-in custom voice corresponding to device number "1" may be deleted. At next step S19, it is determined whether the modification data of that plug-in custom voice may be deleted or not. If, at this time, one of the LCD buttons corresponding to the displayed "OK ?" is activated by the user, it is judged that the modification data of that plug-in custom voice may be deleted, so that the system CPU 10 goes to step S20 in order to clear the storage area in the flash ROM 11 storing the modification data of the plug-in custom voice corresponding to device number "1".

In case the Exit button B2 is activated when the inquiry "OK ?" has been displayed, a negative (NO) determination is made at step S20, so that the system CPU 10 branches to step S21. Step S21 inhibits tone generation by the plug-in board attached to the first slot 22 corresponding to the plug-in custom voice, and then the first slot process is brought to an end. In this case, it is judged that the modification data of the plug-in custom voice has not yet been backed up and the user does not want to delete the modification data and also that the user wants to back up the modification data. Thus, the instant embodiment allows the user to back up the modification data of the plug-in custom voice to the disk 8 by executing the above-mentioned save (quick save) process after the first slot process is terminated to bring the initialization process to an end.

When it has been determined at step S14 that there is no plug-in custom voice or when the operation of step S20 has been completed, the system CPU 10 proceeds to step S15 in order to initialize the tone color name table and parameter name table stored in the flash ROM 11. Then, the tone color name information and parameter name information is fetched at step S16 from the plug-in board currently attached to the first slot 22, and is written into the initialized tables. In this way, the tone color name table and parameter name table as well as the tone color maps are updated so as to correspond to the plug-in board currently inserted in the first slot 22.

When the tone color map updating operation of step S17 has been completed, or when the operation of step S13 has been completed, the first slot process at steps S11 to S21 is brought to an end, and then a second slot process is started up at step S22. This second slot process is similar in contents to the above-described first slot process except that it is performed on the plug-in board attached to the second slot 23, and thus the second slot process is not described here to avoid unnecessary duplication. Then, at step S23, other initialization operations are carried out such as for clearing various registers and setting default tone colors to the individual performance parts. After that, the initialization process is completed, so that control returns to step S3 of the CPU main process.

Figure 14:
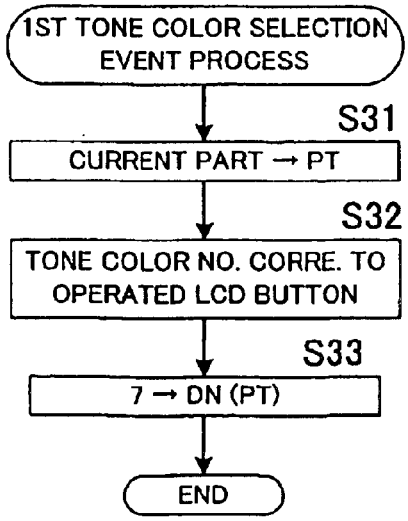
FIG. 14 is a flow chart showing an exemplary operational sequence of a first tone color selection event process carried out by the system CPU in the main body of the electronic musical instrument.

With reference to a flow chart of FIG. 14, the following paragraphs describe a first tone color selection event process carried out by the System CPU 10 when the user performs an operation of FIG. 11A for setting a tone color of a main-body preset voice possessed by the main body of the electronic musical instrument 1.

When the basic screen of FIG. 4 is displayed on the dot-matrix display device DP, the first tone color selection event process is ready to be started. Once the user manipulates any one of the "F"–"J" buttons in the second group of LCD buttons LC2 to thereby select a particular performance part for which a tone color selection is to be made, the particular performance part is set as a current performance part PT at step S31. Then, a tone color group selection operation is performed by activation of any one of the main-body-tone-color selecting buttons B5, where one particular tone color is selected from the displayed tone color group by manipulation of any one of the buttons in the first or second LCD button group LC1 or LC2 as described earlier in relation to FIG. 5. Then, the tone color number of the thus-selected particular tone color is set, at step S32, as the tone color number TC(PT) of the current performance part PT. Because the tone color selected in this case is among those possessed by the tone generator device 27 in the main body of the electronic musical instrument 1, "7" indicative of the tone generator device 27 is set, at step S33, as the device number DN(PT) for the current performance part PT. In this way, the selected main-body preset tone color is set to the selected performance part, and then the first tone color selection event process is brought to an end.

Figure 15:
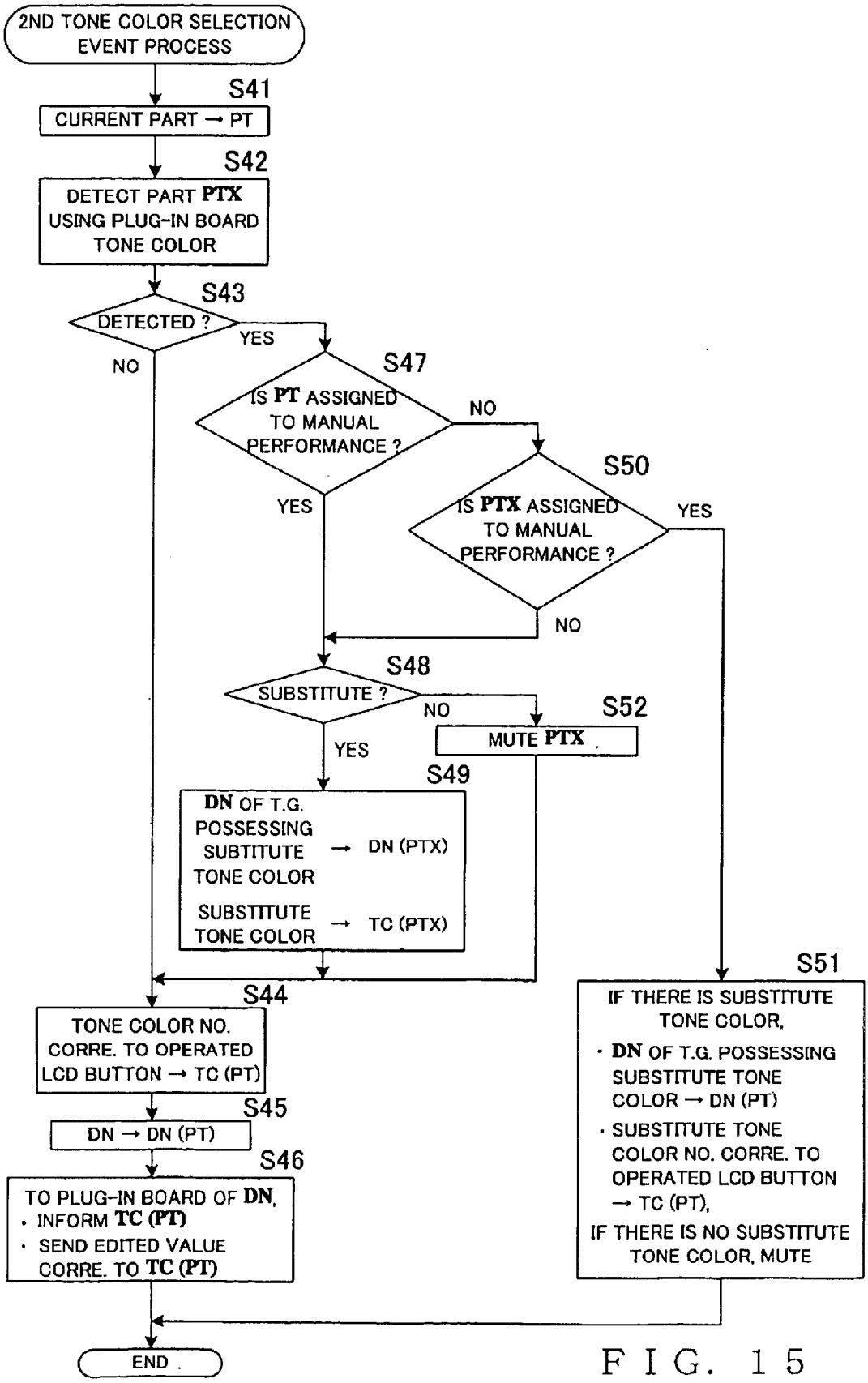
FIG. 15 is a flow chart showing an exemplary operational sequence of a second tone color selection event process carried out by the system CPU in the main body of the electronic musical instrument.

Next, with reference to a flow chart of FIG. 15, a description is made about a second tone color selection event process carried out by the system CPU 10 when the user performs an operation for selecting a tone color of a board preset voice or board custom board voice possessed by the mono-part tone generator plug-in board or plug-in custom voice obtained by editing the board preset voice or board custom board voice.

When the basic screen of FIG. 4 is displayed on the dot-matrix display device DP, the second tone color selection event process is ready to be started. Once the user manipulates any one of the "F"–"J" buttons in the second group of LCD buttons LC2 to thereby select a particular performance part for which a tone color selection is to be made, the particular performance part is set as a current performance part PT at step S41. Then, the user activates the "slot 1" or "slot 2" button in the board-tone-color selecting button group B4. In the case where the "slot 1" button has been activated by the user, a selection is permitted from among the tone colors possessed by the plug-in board attached to the first slot 22, while in the case where the "slot 2" button has been activated by the user, a selection is permitted from among the tone colors possessed by the plug-in board attached to the second slot 23. Because either one of the "slot 1" and "slot 2" buttons is placed in the selected state at the initial stage, if one of the slot 1" and "slot 2" buttons which the user wants to selects is currently still in the selected state, it is not necessary to again operate the same button, as previously noted.

Then, when it is desired to select a board custom voice, any one of the "1"–"9" and "D" buttons in the board-tone-color selecting button group B4 is operated by the user so that the tone color names allocated to the operated button are visually displayed. As previously explained in relation to FIG. 6, a desired tone color can be selected by operating one of the buttons in the first and second LCD button groups which corresponds to a desired one of the thus-displayed tone color names. In the case where the "slot 1" button has been activated to select one of the tone colors possessed by the plug-in board attached to the first slot 22, detection is made, at next step S42, of a performance part PTX currently using the tone color possessed by the plug-in board attached to the first slot allocated device number "1". On the other hand, in the case where the "slot 2" button has been activated to select one of the tone colors possessed by the plug-in board attached to the second slot 23, detection is made, at step S42, of a performance part PTX currently using the tone color possessed by the plug-in board attached to the second slot allocated device number "2".

After that, a determination is made at step S43 as to whether or not the board-tone-color-using performance part PTX has been detected at step S42 above. If such a board-tone-color-using performance part PTX has been detected at step S43, the second tone color selection event process of FIG. 15 branches to step S47, where a further determination is made as to whether the current performance part PT is currently assigned to a manual performance. If the current performance part PT is currently assigned to a manual performance as determined at step S47, the process further branches to step S50 in order to further determine whether the above-mentioned board-tone-color-using performance part PTX is currently assigned to a manual performance. If answered in the affirmative at step S50, then a substitute tone color operation is carried out, at step S51, for setting a substitute tone color to the current performance part PT without changing the tone color of the board-tone-color-using performance part PTX, because changing a tone color allocated to a manual performance should be inhibited. In this substitute tone color operation, if there is an appropriate substitute tone color capable of substituting for the selected tone color, then the device number DN of the tone generator possessing that substitute tone color is set as the device number DN(PT) of the current performance part PT. Further, the tone color number of the substitute tone color corresponding to the tone color selected by manipulation of one of the buttons in the first and second LCD button groups LC1 and LC2 is set as the tone color number TC(PT) of the current performance part PT.

In this case, a tone color of the GM (General MIDI) tone generator, designed to standard tone generator specifications, is selected as the substitute tone color. The GM tone generator is equipped with 128 different tone colors of which the bank select MSB is set to "00" and the bank number is set to "0". For example, where the tone color selected for the current performance part PT is "Violin" corresponding to bank select "50", bank number "0" and program change "41", the substitute tone color is set to "Violin" corresponding to bank select "00", bank number "0" and program change "41". Namely, the tone color number of the substitute tone color differs from that of the selected tone color only in the bank select MSB. Further, in the illustrated example of FIG. 1, the device number DN indicating the tone generator of the substitute tone color is set to "7", because the tone generator device 27 is normally provided with the GM tone generator. Note that if there is no substitute tone color capable of substituting for the selected tone color, the current performance part PT is muted.

Further, if the board-tone-color-using performance part PTX is not a manual performance part as determined at step S50, a determination is made at step S48 as to whether there is a substitute tone color for the board-tone-color-using performance part PTX, with a view to setting, to the current performance part PT, the tone color having so far been set to the board-tone-color-using performance part PTX. If there is such a substitute tone color available from the GM tone generator or the like, the system CPU 10 proceeds to step S49, where the device number DN of the tone generator ("T.G.") possessing that substitute tone color is set as the device number DN(PTX) of the board-tone-color-using performance part PTX. Further, the tone color number of the substitute tone color corresponding to the tone color selected by manipulation of one of the buttons in the first and second LCD button groups LC1 and LC2 is set as the tone color number TC(PTX) of the board-tone-color-using performance part PTX. If, on the other hand, there is no such substitute tone color as determined at step S48, the system CPU 10 branches to step S52 in order to mute the board-tone-color-using performance part PTX.

Further, if the current performance part PT is a manual performance part as determined at step S47, the system CPU 10 goes to step S48 with a view to setting, to the current performance part PT, the tone color having so far been set to the tone-color-using performance part PTX, and the above-mentioned operations are carried out.

Here, when it has been determined at step S43 that there is no board-tone-color-using performance part PTX, or after completion of the operation at step S49 or S52, the system CPU 10 moves on to step S44, where the tone color number of the tone color selected by manipulation of one of the buttons in the first and second LCD button groups LC1 and LC2 is set as the tone color number TC(PT) of the current performance part PT. Then, the system CPU 10 moves on to step S45, where the device number DN of the tone generator (T.G.) possessing the selected tone color is set as the device number DN(PTX) of the current performance part PT. Following step S45, the tone color number TC(PT) having been set to the current performance part PT is informed, at step S46, to the plug-in board of the device number DN possessing the selected tone color in such a manner that the plug-in board can generate a tone of the current performance part PT with the selected tone color. In this way, the tone color parameters of the tone color set to the current performance part PT can be set into the tone generation area of the RAM in the plug-in board. Further, if the tone color of the tone color number TC(PT) is an offset-edited plug-in custom voice, the offset-editing modification data is also sent to the plug-in board. Then, the tone color parameters corresponding to the selected tone color number are modified in accordance with the modification data and then set into the tone generation area of the RAM in the plug-in board. In this way, it is possible to generate a tone of the tone color selected for the current performance part PT and edited by the offset editing operation. After completion of the operation at step S46 or S51, the second tone color selection event process is brought to an end.

Step S48 and step S51 have been described as setting a substitute tone color to the performance part in question if such a substitute tone color is available or present; in an alternative, however, the performance part in question may be muted irrespective presence/absence of the substitute tone color.

As having been described above, in the case where the plug-in board is a mono-part tone generator and if there is a board-tone-color-using performance part PTX assigned to a manual performance, the second tone color selection event process prevents the tone color of the board-tone-color-using performance part PTX from being set to the user-selected performance part (current performance part) PT. Further, if the selected performance part PT is a manual performance part, the second tone color selection event process unconditionally allocates the selected tone color to that performance part PT. Such arrangements permits a tone color selection operation that can reliably avoid an unnatural feeling or unsuitability when human listeners listen to tones of the manual performance. Note that in the case where the plug-in board is a multi-part tone generator capable of allocating tone colors to two or more performance parts, different tone colors possessed by the multi-part tone generator plug-in board can be set to the board-tone-color-using performance part PTX and newly selected performance part PT.

Figure 16A:
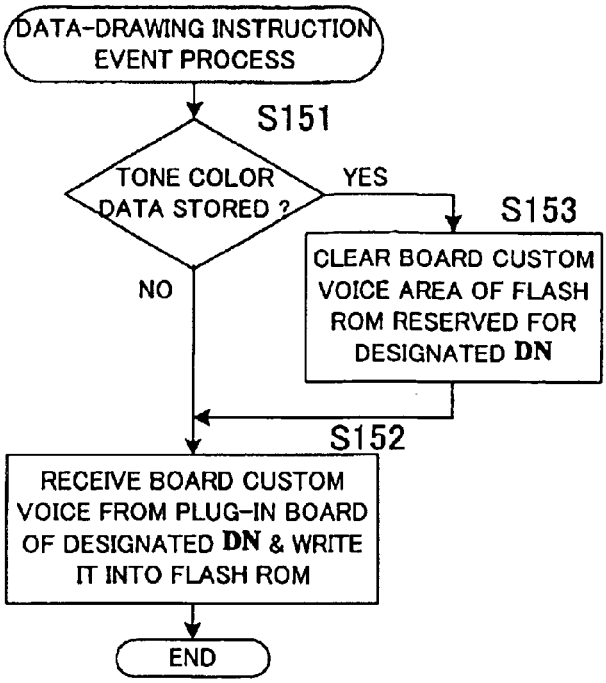
FIGS. 16A and 16B are flow charts showing exemplary operational sequences of a data-drawing instruction event process and a quick-save instruction event process carried out by the system CPU in the main body of the electronic musical instrument.

Further, with reference to a flow chart of FIG. 16A, the following paragraphs describe a data-drawing instruction event process carried out by the system CPU 10 when the user performs an operation for drawing tone color data of a board custom voice, possessed by a plug-in board, to the flash ROM 11 of the main body of the electronic musical instrument 1.

Once the Get button B6 of FIG. 3 is activated, the data-drawing instruction event process is started up, and an inquiry "OK ?" is displayed, on the dot-matrix display device DP, to ask the user whether or not to proceed to execution of the tone color data drawing. If the Go button B3 is activated here, a determination is made, at step S151, as to whether tone color data of a board custom voice are currently stored in the flash ROM 11 into which the tone color data are to be stored. If such tone color data of the board custom voice are currently stored in the flash ROM 11 as determined at step S151, the system CPU 10 branches to step S153 in order to clear a board custom voice area of the flash ROM 11 which is reserved for the designated plug-in board. In this case, the board custom voice area can be identified from the device number DN corresponding to the slot having the plug-in board attached thereto.

Then, at step S152, the board custom voice is received from the plug-in board of the designated device number DN and then written into the corresponding board custom voice area of the flash ROM 11. If, on the other hand, such tone color data of the board custom voice are not currently stored in the flash ROM 11 as determined at step S151, the above-mentioned write operation of step S152 is carried out with the operation of step S153 skipped. After completion of the operation at step S152, the instant data-drawing instruction event process is brought to an end.

Figure 16B:
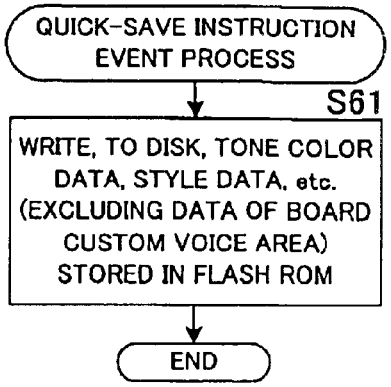

Further, with reference to a flow chart of FIG. 16B, the following paragraphs describe a quick-save instruction event process carried out by the system CPU 10 when the user performs an operation for quickly saving modification data and the like of a plug-in custom voice of a plug-in board, which are stored in the flash ROM 11, onto the disk 8 installed in the disk drive 7.

Once the Save button B7 of FIG. 3 is activated, a screen is displayed on the dot-matric display device DP to ask the user which of the "quick save" and "complete save" modes the user wants to select. If the "quick save" is selected, the quick-save instruction event process is started up so that modification data, style data and the like of a plug-in custom voice, which are stored in the flash ROM 11, are saved, at step S61, onto the disk 8 installed in the disk drive 7. However, tone color data of the board custom voice are excluded from the data to be saved. After completion of the operation at step S61, the instant quick-save instruction event process is brought to an end.

By the above-described quick-save instruction event process being carried out after completion of the initialization in response to the negative determination at step S19 in the initialization process of FIG. 13, it is possible to save the modification data of the plug-in custom voice of the plug-in board before being subjected to the board replacement.

Figure 17:
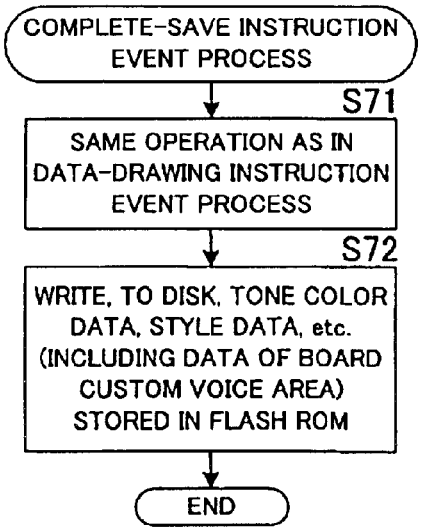
FIG. 17 is a flow chart showing an exemplary operational sequence of a complete-save instruction event process carried out by the system CPU in the main body of the electronic musical instrument.

Further, with reference to a flow chart of FIG. 17, the following paragraphs describe a complete-save instruction event process carried out by the system CPU 10 when the user performs an operation for completely saving tone color data of a board custom voice and modification data of a plug-in custom voice of a plug-in board, which are stored in the flash ROM 11, onto the disk 8 installed in the disk drive 7.

Once the Save button B7 of FIG. 3 is activated, a screen is displayed on the dot-matrix display device DP to ask the user which of the "quick save" and "complete save" modes the user wants to select. If the "complete save" is selected, the complete-save instruction event process is started up so that operations similar to those of the data-drawing instruction event process, described above in relation to FIG. 16A, are carried out at step S71. In this way, the tone color data of the latest board custom voice can be stored into the flash ROM 11. Then, at step S72, various data, such as the tone color data of the board custom voice, style data and modification data of the plug-in custom voice, which are stored in the flash ROM 11, are saved onto the disk 8 installed in the disk drive 7. Upon completion of the operation at step S72, the instant complete-save instruction event process is brought to an end.

Figure 18:
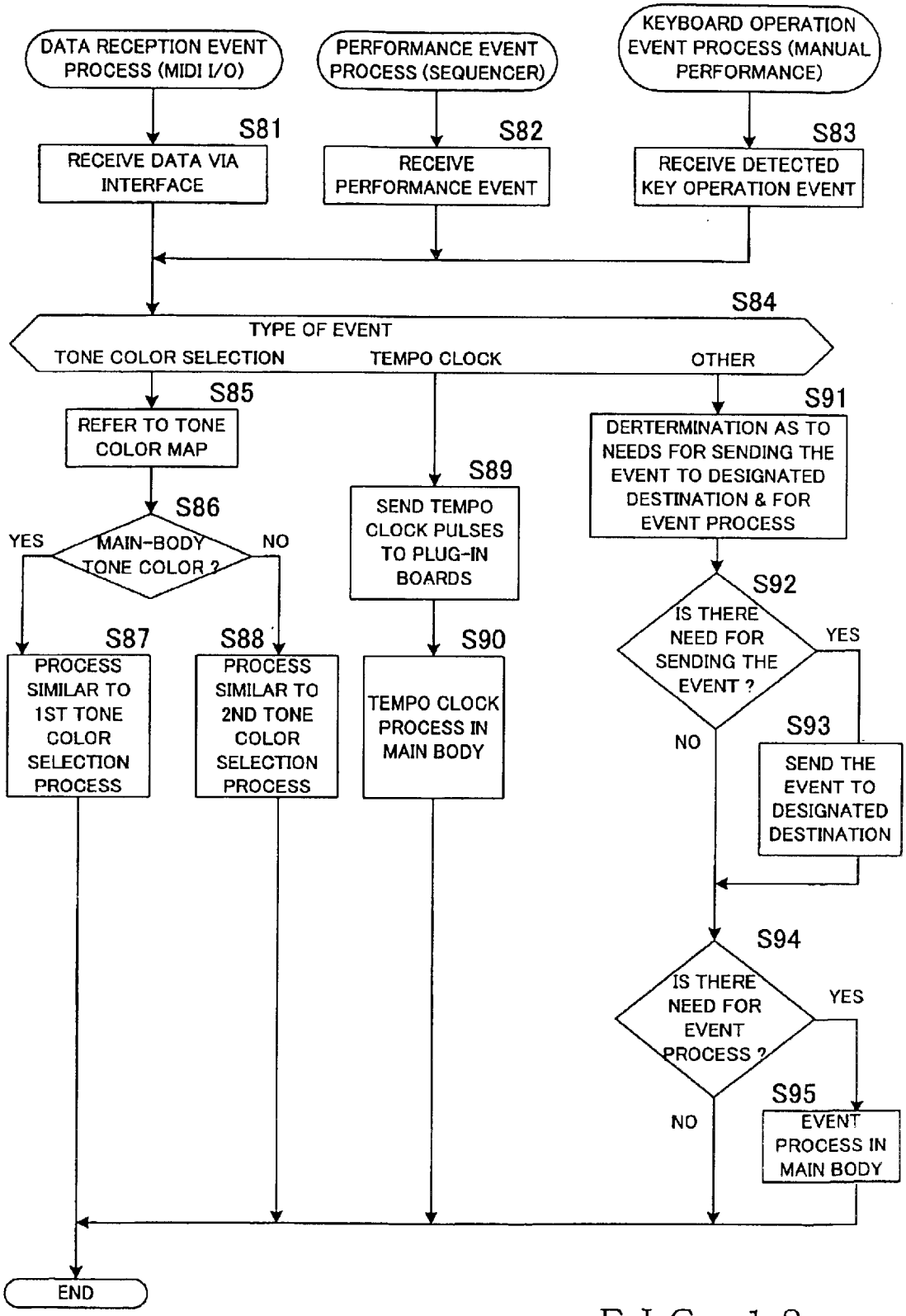
FIG. 18 is a flow chart showing an exemplary operational sequence of event-related processing carried out by the system CPU when an event occurs in the main body of the electronic musical instrument.

Now, a description will be made about event-related processing carried out by the system CPU 10 in response occurrence of various events in the main body of the electronic musical instrument 1, with reference to a flow chart of FIG. 18.

Once a MIDI signal is input via the MIDI-IN terminal 17, a data reception event process (MIDI I/O process) is started up, where parallel MIDI signal events are received at step S81 via the photocoupler 18 or serial interface 19. Further, when an automatic performance/accompaniment is to be executed in the main body of the electronic musical instrument 1, a performance event process (sequencer process) is started up, where each performance event having occurred is received at step S82. Furthermore, when a performance is to be executed by the keyboard 5, a keyboard operation event process (manual performance process) is started up, where each event of detected key operation is received at step S83. These data reception event process (MIDI I/O process), performance event process (sequencer process) and keyboard operation process (manual performance process) can be started up simultaneously, and events occurring as these processes are carried out are merged and processed on an event-by-event basis.

Namely, the type of each merged event to be processed subsequently is identified at step S84. If the event is data of a bank select and program change, then the event type is identified as a tone color selection event, so that the system CPU 10 goes to step S85. The tone color selection event includes data of a combination of "bank select MSB plus bank number plus program change", and at step S85, the device number DN corresponding to the data is obtained with reference to a tone color map stored in the flash ROM 11. At following step S86, it is determined, on the basis of the device number DN obtained at step S85, whether the tone color selection event is one pertaining to a tone color possessed by the main body of the electronic musical instrument 1 or one pertaining to a tone color possessed by the plug-in board. If the obtained device number DN is "7" and the tone color selection event has been determined, at step S86, as one pertaining to a tone color possessed by the main body of the electronic musical instrument 1, the system CPU 10 goes to step S87, where is carried out a tone color selection process similar to the first tone color selection event process described earlier in relation to FIG. 14. The first tone color selection event process differs from the tone color selection process of step S87 in that the former can not display non-supported tone colors and thus can not select any one of the non-supported tone colors. However, because the tone color selection event process of step S87 can select any tone color designated by the "bank select MSB plus bank number plus program change" data, it will select even a non-supported tone color.

If the obtained device number DN is "1" or "2" and the tone color selection event has been determined, at step S86, as one pertaining to a tone color possessed by the plug-in board, the system CPU 10 goes to step S88, where is carried out a tone color selection process similar to the second tone color selection event process described earlier in relation to FIG. 15. The second tone color selection event process differs from the tone color selection process of step S88 in that the former can not display non-supported tone colors and thus can not select any one of the non-supported tone colors. However, because the tone color selection event process of step S88 can select any tone color designated by the "bank select MSB plus bank number plus program change" data, it will select even a non-supported tone color, similarly to the tone color selection event process of step S87.

Note that in case a non-supported tone color has been selected for a particular performance part, that performance part is muted.

Further, if the event type identified at step S84 is a tempo clock event caused during an automatic performance/accompaniment, the system CPU 10 goes to step S89, where tempo clock pulses are supplied to the plug-in boards of device numbers "1" and "2". Each of the plug-in boards attached to the first and second slots is caused to generate a tone on the basis of the supplied tempo clock pulses. Thus, even when a tone color of a sequenced voice has been selected for at least one of the plug-in boards, a pattern possessed by a plug-in board voice can be synchronized with a performance of the main body of the electronic musical instrument 1. Then, at step S90, automatic performance/accompaniment tones are generated by the tone generator device 27 on the basis of the tempo clock pulses.

Further, if the event type identified at step S84 is a performance event or other event, the system CPU 10 goes to step S91 in order to determine whether there is a need to send the event to a designated destination and whether an event process is necessary in the main body of the electronic musical instrument 1. If the event is a performance event and a performance part corresponding to the performance event is set in the plug-in board, then it is determined at step S91 that there is a need to send the event to the plug-in board and that no event process is necessary in the main body of the electronic musical instrument 1. Further, where the event is a performance event and performance part corresponding to the performance event is set in the main body of the electronic musical instrument 1, it is determined at step S91 that there is no need to send the event and that an event process is necessary in the main body of the electronic musical instrument 1. Then, at step S92, it is ascertained whether step S91 has determined that there is the need to send the event. With an affirmative answer at step S92, the system CPU 10 goes to step S93, where the event is sent to the designated destination. If, on the other hand, step S91 has determined that there is no need to send the event, the system CPU 10 moves on to step S94 skipping step S93, where it is ascertained whether step S91 has determined that the event process is necessary in the main body of the electronic musical instrument 1. If step S91 has determined that the event process is necessary in the main body of the electronic musical instrument 1, the system CPU 10 goes to step S95, where the event process is carried out in the main body of the electronic musical instrument 1. If, on the other hand, step S91 has determined that no event process is necessary in the main body of the electronic musical instrument 1, the operation of step S95 is skipped. The event-related processing carried out by the system CPU 10 in response occurrence of various events in the main body of the electronic musical instrument 1 is brought to an end after completion of the operation at step S87, S88, S90, S94 or S95. Such event-related processing is triggered and executed each time an event occurs.

In summary, the present invention is characterized primarily by storing tone color name information and tone color parameter name information in a nonvolatile memory such as a flash ROM, so that the tone color name information and tone color parameter name information can be obtained without inquiring each time such information is required. Whenever one plug-in board attached to the main body of the electronic musical instrument has been replaced with another plug-in board (i.e., whenever a plug-in board replacement takes place), the present invention operates to collectively update the stored contents of the nonvolatile memory with a plurality of names of tone colors and parameters available from the other or newly attached plug-in board, so that even when the plug-in board replacement occurs, it is possible to readily use the tone colors possessed by the newly attached plug-in board.

Further, with the present invention, tone color information of a custom voice possessed by the plug-in board can be backed up to the nonvolatile memory in the main body of the electronic musical instrument. Thus, upon turning-on of the power to (i.e., powering-up) the main body of the electronic musical instrument, the backed-up custom voice tone color information can be written into the plug-in board, which allows the custom voice tone color information to be used immediately after the powering-up, without a need for transferring the custom voice tone color information from outside. Upon the powering up, the present invention makes a determination, as to whether plug-in board identification information obtained from the attached plug-in board matches with plug-in board identification information currently stored in the nonvolatile memory, so that if the two plug-in board identification information matches with each other, the present invention judges that no plug-in board replacement has taken place and then writes the backed-up custom voice tone color information into the attached plug-in board. In the present invention, the custom voice tone color information stored in the nonvolatile memory can also be stored into an external storage medium. Further, in the present invention, custom voice tone color information stored in an external storage medium can be loaded into the nonvolatile memory. Thus, the present invention can prevent an unwanted loss of the custom voice tone color information.

The present invention is further characterized by provision of an offset editing means for editing a tone color, possessed by the plug-in board, by adding desired modification data to tone color data of the tone color in question. With this arrangement, the tone color possessed by the plug-in board can also be edited by the main body of the electronic musical instrument. Because the offset editing means does not change values of the tone color parameter themselves, the editing by the offset editing means in the main body of the electronic musical instrument can be reliably prevented from conflicting with editing performed outside the main body of the electronic musical instrument. Furthermore, when any one of the offset-edited tone colors has been selected, the present invention causes the tone color number and modification data of the selected tone color to be transferred to the attached plug-in board, and thus the attached plug-in board can generate a tone with the tone color offset-edited in accordance with the modification data.

Moreover, where the plug-in board is one constructed as a mono-part tone generator and a tone color of this mono-part tone generator has been selected for a particular performance part, the present invention operates to inhibit (mute) tone generation in the particular performance part when the same tone color of the mono-part tone generator is subsequently designated for another performance part, and also set the tone color of the mono-part tone generator to the other performance part. In this case, the particular performance part may be changed to a substitute tone color available from another tone generator. In this way, even where the plug-in board is a mono-part tone generator, the tone color of the mono-part tone generator can be set to any other performance part without a need for changing settings of the particular performance part. In addition, in a situation where the tone color of the mono-part tone generator has been selected for a manual performance part, the present invention inhibits the tone color of the mono-part tone generator from being set to another performance part even when the tone color of the mono-part tone generator has ben designated for the other performance part, so that the present invention can effectively prevent unnaturalness or unsuitability in performance tones of the manual performance.

Moreover, the present invention is arranged to merge or combine together performance information, such as a MIDI signal, supplied from outside and performance information, such as a MIDI signal, generated in the main body of the electronic musical instrument, and then supply the thus merged performance information to the tone generator device and attached plug-in board. This arrangement can synchronize tones generated by the plug-in board with a performance by the main body of the electronic musical instrument. In this case, even when a sequenced voice has been selected as the tone color of said plug-in board for an automatic performance/accompaniment by the main body of the electronic musical instrument, the present invention allows a pattern performance of the sequenced voice to synchronize with the performance of the main body, provided that the main body of the electronic musical instrument is arranged to supply tempo clock pulses, to be used for the automatic performance/accompaniment, to the attached plug-in board.

What is claimed is:

1. A tone generation apparatus for generating a tone on the basis of performance information, a plug-in board being removably attachable to said tone generation apparatus, said plug-in board being capable of generating a tone on the basis of performance information and extending a tone generating function of said tone generation apparatus, said tone generation apparatus comprising:

a nonvolatile memory that is capable of storing at least one of a set of all tone color name information and a set of all tone parameter name information of tone color data possessed by said plug-in board attached to said tone generation apparatus;

a display that displays tone color names, on the basis of the tone color name information stored in said nonvolatile memory, when any one of tone colors possessed by said plug-in board is selected, or displays tone color parameter names, on the basis of the tone color parameter name information stored in said nonvolatile memory, when any one of the tone colors possessed by said plug-in board is to be edited;

a detector that detects whether a plug-in board replacement has taken place in said tone generation apparatus; and an updating processing section that, when it is detected by said detector that the plug-in board replacement has taken place, updates stored contents of said nonvolatile memory with tone color name information or tone parameter name information of tone color data possessed by another plug-in board newly attached to said tone generation apparatus.

2. A tone generation apparatus as claimed in claim 1 wherein said nonvolatile memory is further capable of storing plug-in board identification information identifying said plug-in board attached to said tone generation apparatus, and wherein said detector detects whether or not the plug-in board replacement has taken place in said tone generation apparatus, by comparing plug-in board identification information obtained from said plug-in board attached to said tone generation apparatus and the plug-in board identification information stored in said nonvolatile memory.

3. A tone generation apparatus to which a plug-in board is removably attachable, said plug-in board being capable of generating a tone on the basis of performance information and extending a tone generating function of said tone generation apparatus, said tone generation apparatus comprising:

a tone generation section that generates a tone on the basis of performance information;

a tone color selection section that selects tone colors of tones to be generated by said plug-in board attached to said tone generation apparatus and by said tone generation section;

an offset editing section that edits a tone color possessed by said plug-in board attached to said tone generation apparatus, by adding desired modification data to tone color data of the tone color possessed by said plug-in board, the desired modification data being prestored in said tone generation apparatus; and a transfer control section that, when any tone color is selected via said tone color selection section, transfers a tone color number and the modification data of the selected tone color to said plug-in board if the selected tone color has already been edited by said offset editing section, but transfers only the tone color number of the selected tone color if the selected tone color has not yet been edited by said offset editing section.

4. A tone generation apparatus for generating a tone on the basis of performance information, a plug-in board being removably attachable to said tone generation apparatus, said plug-in board being capable of generating a tone on the basis of performance information and extending a tone generating function of said tone generation apparatus, said tone generation apparatus comprising:

a performance information generation section that generates first performance information on the basis of a readout from a storage device;

a performance information reception section that receives second performance information given from outside said tone generation apparatus;

a merging processing section that merges said first performance information generated by said performance information generation section and said second performance information received by said performance information reception section, to thereby provide merged performance information, wherein a tone is generated by at least one of said tone generation apparatus and said plug-in board on the basis of the merged performance information provided by said merging processing section; and a supply section that supplies tempo clock information to said plug-in board attached to said tone generation apparatus, whereby said plug-in board is allowed to generate a tone in synchronism with the tempo clock information supplied by said supply section.

5. A tone generation apparatus to which a mono-part tone generator plug-in board and another plug-in board are removably attachable, said mono-part tone generator plug-in board including a mono-part tone generator device that generates a tone in response to a performance of one particular performance part from among performances of a predetermined plurality of performance parts, said tone generation apparatus comprising:

a tone generation section that generates tones of one or more performance parts in response to performances of one or more performance parts from among performances of a predetermined plurality of performance parts;

a tone color selection section that selects tone colors of tones to be generated by said tone generation section and said mono-part tone generator device; and a control section that, when a tone color selected for a tone of one given performance part being generated by said mono-part tone generator device has been selected by said tone color selection section as a tone color for a tone of another performance part, performs control to cause said tone generation section or the other plug-in board to generate the tone of the one given performance part with a substitute tone color for the selected tone color and performs control to cause said mono-part tone generator device to generate the tone of the other performance part with the selected tone color.

6. A tone generation apparatus to which a mono-part tone generator plug-in board and another plug-in board are removably attachable, said mono-part tone generator plug-in board including a mono-part tone generator device that generates a tone in response to a performance of one particular performance part from among performances of a predetermined plurality of performance parts, said tone generation apparatus comprising:

a tone generation section that generates tones of one or more performance parts in response to performances of one or more performance parts from among performances of a predetermined plurality of performance parts;

a tone color selection section that selects tone colors of tones to be generated by said tone generation section and said mono-part tone generator device; and a control section that, when a tone of one given performance part being generated by said mono-part tone generator device corresponds to a manual performance and when a tone color selected for the tone of the one given performance part has been selected by said tone color selection section as a tone color for a tone of another performance part, performs control to cause said tone generation section or the other plug-in board to generate the tone of the other performance part with a substitute tone color for the selected tone color, and thereby allows said mono-part tone generator device to continue generating the tone of the one given performance part with the selected tone color.

7. A storage management method for use with a tone generation apparatus to which a plug-in board is removably attachable, said plug-in board being capable of generating a tone on the basis of performance information and extending a tone generating function of said tone generation apparatus, said tone generation apparatus including a nonvolatile memory that is capable of storing at least one of a set of all tone color name information and a set of all tone parameter name information of tone color data possessed by said plug-in board attached to said tone generation apparatus, said storage management method comprising:

a step of displaying tone color names, on the basis of the tone color name information stored in said nonvolatile memory, when any one of tone colors possessed by said plug-in board is selected, or displaying tone color parameter names, on the basis of the tone color parameter name information stored in said nonvolatile memory, when any one of the tone colors possessed by said plug-in board is to be edited;

a step of detecting whether a plug-in board replacement has taken place in said tone generation apparatus; and a step of, when it is detected by said step of detecting that the plug-in board replacement has taken place, updating stored contents of said nonvolatile memory with tone color name information or tone parameter name information of tone color data possessed by another plug-in board newly attached to said tone generation apparatus.

8. A machine-readable storage medium containing a group of instructions to cause said machine to perform the storage management method as claimed in claim 7.

9. A tone color control method for use with a tone generation apparatus to which a plug-in board is removably attachable, said plug-in board being capable of generating a tone on the basis of performance information and extending a tone generating function of said tone generation apparatus, said tone color control method comprising:

a step of selecting a tone color of a tone to be generated by said plug-in board attached to said tone generation apparatus;

a step of editing a tone color possessed by said plug-in board, by adding desired modification data to tone color data of the tone color possessed by said plug-in board, the desired modification data being prestored in said tone generation apparatus; and a step of, when any tone color is selected via said step of selecting, transferring a tone color number and the modification data of the selected tone color to said plug-in board if the selected tone color has already been edited by said step of editing to thereby allow the selected tone color of the transferred tone color number to be controlled by said plug-in board in accordance with the transferred modification data, but transferring only the tone color number of the selected tone color if the selected tone color has not yet been edited by said step of editing.

10. A machine-readable storage medium containing a group of instructions to cause said machine to perform the tone color control method as claimed in claim 9.

11. A tone generation method using a tone generation apparatus to which a plug-in board is removably attachable, said plug-in board being capable of generating a tone on the basis of performance information and extending a tone generating function of said tone generation apparatus, said tone generation method comprising:

a step of generating first performance information on the basis of a readout from a storage device;

a step of receiving second performance information given from outside said tone generation apparatus;

a step of merging said first performance information generated by said step of generating and said second performance information received by said step of receiving, to thereby provide merged performance information, wherein a tone is generated by at least one of said tone generation apparatus and said plug-in board on the basis of the merged performance information provided by said merging processing section; and a step of supplying tempo clock information to said plug-in board attached to said tone generation apparatus, whereby said plug-in board is allowed to generate a tone in synchronism with the tempo clock information supplied by said step of supplying.

12. A machine-readable storage medium containing a group of instructions to cause said machine to perform the tone generation method as claimed in claim 11.

13. A tone generation method for use with a tone generation apparatus to which a mono-part tone generator plug-in board and another plug-in board are removably attachable, said mono-part tone generator plug-in board including a mono-part tone generator device that generates a tone in response to a performance of one particular performance part from among performances of a predetermined plurality of performance parts, said tone generation method comprising:

a step of generating tones of one or more performance parts in response to performances of one or more performance parts from among performances of a predetermined plurality of performance parts;

a step of selecting tone colors of tones to be generated by said step of generating and said mono-part tone generator device; and a control step of, when a tone color selected for a tone of one given performance part being generated by said mono-part tone generator device has been selected by said step of selecting as a tone color for a tone of another performance part, performing control to cause said tone generation section or the other plug-in board to generate the tone of the one given performance part with a substitute tone color for the selected tone color and performing control to cause said mono-part tone generator device to generate the tone of the other performance part with the selected tone color.

14. A machine-readable storage medium containing a group of instructions to cause said machine to perform the tone generation method as claimed in claim 13.

15. A tone generation control method for use with a tone generation apparatus to which a mono-part tone generator plug-in board and another plug-in board are removably attachable, said mono-part tone generator plug-in board including a mono-part tone generator device that generates a tone in response to a performance of one particular performance part from among performances of a predetermined plurality of performance parts, said tone generation control method comprising:

a step of generating tones of one or more performance parts in response to performances of one or more performance parts from among performances of a predetermined plurality of performance parts;

a step of selecting tone colors of tones to be generated by said step of generating and said mono-part tone generator device; and a control step of, when a tone of one given performance part being generated by said mono-part tone generator device corresponds to a manual performance and when a tone color selected for the tone of the one given performance part has been selected by said step of selecting as a tone color for a tone of another performance part, performing control to cause said tone generation section or the other plug-in board to generate the tone of the other performance part with a substitute tone color for the selected tone color and thereby allowing said mono-part tone generator device to continue generating the tone of the one given performance part with the selected tone color.

16. A machine-readable storage medium containing a group of instructions to cause said machine to perform the tone generation control method as claimed in claim 15.

17. A tone generation apparatus to which a plug-in board is removably attachable, said tone generation apparatus comprising:

a tone generation section that causes the attached plug-in board and a tone generator device provided within said tone generation section to generate a tone on the basis of performance information;

a performance information generation section that generates performance information including tempo clock information to be used in an automatic performance or automatic accompaniment;

a performance information reception section that receives performance information given from outside said tone generation apparatus; and a merging processing section that merges the performance information generated by said performance information generation section and the performance information received by said performance information reception section, to thereby provide merged performance information, wherein, on the basis of the merged performance information, said performance information generation section causes the attached plug-in board and said tone generator device to generate a tone synchronized to the tempo clock information.

18. A tone generation apparatus having a plurality of slots each provided for attachment of a plug-in board, said tone generation apparatus comprising:

a tone generation section that causes plug-in boards attached to respective one of the slots and a tone generator device provided within said tone generation section to generate a tone on the basis of performance information;

a nonvolatile memory capable of storing, in association with the plurality of slots, tone color data of custom voices stored in said plug-in boards attached to the respective slots and board identification of said plug-in boards;

a storage section capable of storing, in said nonvolatile memory, the tone color data of the custom voices stored in a RAM provided in said plug-in board attached to each of the slots, along with the board identification information of said plug-in board; and a detection section that, upon power-on, determines whether there is a match between the board identification obtained from said plug-in board attached to each of the slots and the board identification information of the slot stored in said nonvolatile memory, wherein, when said detection section determines that there is the match, the tone color data of the custom voices in said plug-in board of the slot, stored in said nonvolatile memory, are written into the RAM provided in said plug-in board.

19. A tone generation apparatus as claimed in claim 18 which further comprises input/output control section that transfers the tone color information of the custom voice, stored in said nonvolatile memory, to an external storage medium for saving, thereto, of the tone color information of the custom voice and that receives tone color information of a custom voice stored in an external storage medium and loads the received tone color information into said nonvolatile memory.

20. A tone generation method using a tone generation apparatus to which a plug-in board is removably attachable, said tone generation method comprising:

a step of generating a tone by the attached plug-in board and a tone generator device within said tone generation apparatus on the basis of performance information;

a step of generating performance information including tempo clock information to be used in an automatic performance or automatic accompaniment;

a step of receiving performance information given from outside said tone generation apparatus; and a step of merging the performance information generated by said step of generating performance information and the performance information received by said step of receiving performance information, to thereby provide merged performance information, wherein, on the basis of the merged performance information, causing the attached plug-in board and said tone generator device to generate a tone synchronized to the tempo clock information.

21. A machine-readable storage medium containing a group of instructions to cause said machine to perform the tone generation method as claimed in claim 20.

22. A tone generation method using a tone generation apparatus having a plurality of slots each provided for attachment of a plug-in board, said tone generation method comprising:

a step of generating a tone by plug-in boards attached to respective one of the slots and a tone generator device within said tone generation apparatus on the basis of performance information, wherein said tone generation apparatus comprises a nonvolatile memory capable of storing, in association with the plurality of slots, tone color data of custom voices stored in said plug-in boards attached to the respective slots and board identification of said plug-in boards in a nonvolatile memory;

a step of storing, in said nonvolatile memory, the tone color data of the custom voices stored in a RAM provided in said plug-in board attached to each of the slots, along with the board identification information of said plug-in board; and a step of detecting, upon power-on, determines whether there is a match between the board identification obtained from said plug-in board attached to each of the slots and the board identification information of the slot stored in said nonvolatile memory, wherein, when said step of detecting determines that there is the match, the tone color data of the custom voices in said plug-in board of the slot, stored in said nonvolatile memory, are written into the RAM provided in said plug-in board.

23. A machine-readable storage medium containing a group of instructions to cause said machine to perform the storage management method as claimed in claim 22.

* * * * *